US011982139B2

(12) United States Patent
Saunders et al.

(10) Patent No.: US 11,982,139 B2
(45) Date of Patent: May 14, 2024

(54) PASSIVE SPACER SYSTEM

(71) Applicant: NATIONAL OILWELL VARCO, L.P., Houston, TX (US)

(72) Inventors: Christopher J. Saunders, Conroe, TX (US); Andrew Ian McKenzie, Cypress, TX (US); Justin Benjamin Kinney, Katy, TX (US); Neil West, Norco, CA (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 17/453,383

(22) Filed: Nov. 3, 2021

(65) Prior Publication Data

US 2023/0134100 A1 May 4, 2023

(51) Int. Cl.
*E21B 19/14* (2006.01)

(52) U.S. Cl.
CPC ..... *E21B 19/14* (2013.01)

(58) Field of Classification Search
CPC ..... A47F 7/0014; A47F 7/0042; B65G 1/14; B65G 57/03; E21B 19/14; E21B 19/155
See application file for complete search history.

(56) References Cited

U.S. PATENT DOCUMENTS 1,386,210 A 8/1921 Thomas
1,494,524 A 5/1924 Adamson
1,818,278 A 8/1931 Siler
1,947,553 A 2/1934 Johnston
2,109,344 A 2/1938 Selger
2,314,867 A 3/1943 Alexander
2,531,930 A 11/1950 Woolslayer et al.
2,615,681 A 10/1952 True
2,619,234 A * 11/1952 Stone ..... E21B 19/14 211/70.4
2,735,556 A 2/1956 Stone
2,885,096 A 5/1959 De Jarnett
2,946,464 A 7/1960 Guier
3,225,949 A 12/1965 Erickson et al.
3,272,365 A 9/1966 Stevens
3,361,453 A 1/1968 Brown et al.
3,533,516 A 10/1970 Guier
(Continued)

FOREIGN PATENT DOCUMENTS

CA 2911388 A1 11/2014
CA 2855105 A1 12/2015
(Continued)

OTHER PUBLICATIONS

"U.S. Appl. No. 16/098,160, Advisory Action dated Jul. 22, 2020", 5 pgs.
(Continued)

*Primary Examiner* — Gregory W Adams
(74) *Attorney, Agent, or Firm* — Schwegman Lundberg & Woessner, P.A.

(57) ABSTRACT

A passive spacer system may include a racking board comprising a slot and a spacer arranged along the slot such that a portion of the spacer impinges on the slot. The spacer may be biased in a neutral position and configured to move to a spacing position due to motion of tubulars into and out of the racking board, which interact with the portion of the spacer that impinges on the slot.

18 Claims, 14 Drawing Sheets

(56) References Cited

U.S. PATENT DOCUMENTS 3,612,286 A 10/1971 Langowski et al.
3,615,027 A 10/1971 Ham
3,616,941 A 11/1971 Walling
3,623,753 A 11/1971 Henry
3,747,789 A 7/1973 Shipley et al.
3,768,663 A 10/1973 Turner et al.
3,840,128 A 10/1974 Swoboda et al.
3,877,583 A 4/1975 Bokenkamp
3,921,823 A 11/1975 Bourree et al.
3,976,207 A 8/1976 Schultz
3,986,569 A * 10/1976 Hilding ..... E21B 19/20 175/85
3,994,350 A 11/1976 Smith et al.
4,042,123 A 8/1977 Sheldon et al.
4,117,941 A 10/1978 Mccleskey, Jr. et al.
4,126,348 A 11/1978 Palmer
4,269,554 A 5/1981 Jackson
4,274,778 A 6/1981 Putnam et al.
4,289,442 A 9/1981 Stevens
4,348,920 A 9/1982 Boyadjieff
4,359,162 A * 11/1982 Mayer ..... B65G 1/14 312/351
4,397,605 A 8/1983 Cowgill et al.
4,531,875 A 7/1985 Krueger
4,591,006 A 5/1986 Hutchison et al.
4,621,974 A 11/1986 Krueger
4,680,519 A 7/1987 Chand et al.
4,715,761 A 12/1987 Berry et al.
4,738,321 A 4/1988 Olivier
4,846,357 A 7/1989 Sholl et al.
4,899,095 A 2/1990 Kishi et al.
5,005,712 A * 4/1991 Niederprum ..... B65G 1/14 53/244
5,038,871 A 8/1991 Dinsdale
5,211,251 A 5/1993 Woolslayer
5,494,320 A 2/1996 Cerruti
5,813,286 A 9/1998 Hansen
5,921,329 A 7/1999 Armstrong
6,047,771 A 4/2000 Roeynestad
6,260,646 B1 7/2001 Fernandez et al.
6,412,576 B1 7/2002 Meiners
7,137,616 B2 11/2006 Kysely
7,249,639 B2 7/2007 Belik
7,341,281 B2 3/2008 Guesnon et al.
7,370,707 B2 5/2008 Mcdaniel et al.
7,390,032 B2 6/2008 Hughes
7,493,960 B2 2/2009 Leising et al.
7,726,929 B1 6/2010 Orgeron
7,905,311 B2 3/2011 Brown
7,946,795 B2 5/2011 Orgeron
7,984,757 B1 7/2011 Keast et al.
8,074,484 B2 12/2011 Denkmeier et al.
8,191,637 B2 6/2012 Havinga
8,210,269 B2 7/2012 Hudson et al.
8,317,448 B2 11/2012 Hankins et al.
8,504,206 B2 8/2013 Fudaba et al.
8,550,761 B2 10/2013 Belik et al.
8,690,508 B1 4/2014 Orgeron
9,133,968 B2 9/2015 Elrick et al.
9,291,010 B1 3/2016 Barnes
9,388,923 B2 7/2016 Romano
10,047,908 B1 8/2018 Bohle, II et al.
10,053,934 B2 8/2018 Keogh et al.
10,246,952 B2 4/2019 Trydal et al.
10,280,002 B2 * 5/2019 Giachero ..... B65G 1/14
10,384,907 B2 8/2019 Upmeier et al.
10,519,726 B2 * 12/2019 Berry ..... E21B 19/14
10,794,126 B2 10/2020 Magnuson
10,829,318 B2 * 11/2020 Kreft ..... A47F 7/0014
10,995,564 B2 5/2021 Miller et al.
11,035,183 B2 6/2021 Donnally et al.
11,220,888 B2 1/2022 Ocegueda-Hernandez et al.
11,274,508 B2 3/2022 Mckenzie et al.
2002/0175519 A1 11/2002 Mack et al.
2003/0159854 A1 8/2003 Simpson et al.
2004/0057815 A1 3/2004 Woolslayer et al.
2005/0055132 A1 3/2005 Matsumoto et al.
2005/0113971 A1 5/2005 Zhang et al.
2005/0126792 A1 6/2005 Berry
2006/0081379 A1 4/2006 Fehres et al.
2006/0104747 A1 5/2006 Zahn et al.
2006/0124316 A1 6/2006 Pietras
2006/0231344 A1 10/2006 Drzewiecki
2006/0249292 A1 11/2006 Guidry
2007/0062705 A1 3/2007 Schats et al.
2007/0114069 A1 5/2007 Hooper et al.
2007/0228671 A1 10/2007 Norton
2008/0136203 A1 6/2008 Krijnen et al.
2008/0202812 A1 8/2008 Childers et al.
2008/0238095 A1 10/2008 Yater et al.
2008/0296065 A1 12/2008 Standal
2009/0283324 A1 11/2009 Konduc et al.
2010/0163247 A1 7/2010 Wright et al.
2010/0193198 A1 8/2010 Murray et al.
2010/0303586 A1 12/2010 Hankins et al.
2011/0079434 A1 4/2011 Belik et al.
2011/0120730 A1 5/2011 Clasen et al.
2011/0147009 A1 6/2011 Dupal et al.
2011/0226485 A1 9/2011 Seneviratne et al.
2012/0018222 A1 1/2012 Hankins et al.
2012/0259337 A1 10/2012 Del Rio et al.
2013/0075114 A1 3/2013 Dekker et al.
2013/0142607 A1 6/2013 Ditzler
2013/0146305 A1 6/2013 Dupal et al.
2014/0050522 A1 2/2014 Slaughter, Jr. et al.
2014/0054089 A1 2/2014 Sondervik
2014/0097027 A1 4/2014 Marica et al.
2014/0145408 A1 5/2014 Midas et al.
2014/0202769 A1 7/2014 Magnuson
2015/0053424 A1 2/2015 Wiens et al.
2015/0127152 A1 5/2015 Nammoto et al.
2015/0148952 A1 5/2015 Shiratsuchi
2015/0232272 A1 8/2015 Magnuson
2015/0272579 A1 10/2015 Leimbach et al.
2015/0273688 A1 10/2015 Harada et al.
2015/0275596 A1 10/2015 Hickie
2015/0283704 A1 10/2015 Watanabe
2015/0330162 A1 11/2015 Magnuson et al.
2016/0060979 A1 3/2016 Magnuson
2016/0115745 A1 4/2016 Bisel
2016/0145954 A1 5/2016 Helms et al.
2016/0160586 A1 6/2016 Keogh et al.
2016/0168929 A1 6/2016 Magnuson et al.
2016/0201408 A1 7/2016 Little et al.
2017/0172295 A1 6/2017 Tropper
2017/0204687 A1 7/2017 Yorga et al.
2017/0232620 A1 8/2017 Kalb et al.
2017/0234088 A1 8/2017 Orr et al.
2017/0260818 A1 9/2017 Berry et al.
2018/0171724 A1 6/2018 Daigle et al.
2018/0238120 A1 8/2018 Patterson et al.
2018/0245408 A1 8/2018 Keogh et al.
2018/0328112 A1 11/2018 Berry et al.
2018/0334865 A1 11/2018 Miller et al.
2019/0017334 A1 1/2019 Loeyning et al.
2019/0063649 A1 2/2019 Snyder, II
2019/0119995 A1 * 4/2019 Gullaksen ..... E21B 19/155
2019/0143532 A1 5/2019 Cutkosky et al.
2019/0145197 A1 5/2019 Callaghan
2019/0309585 A1 10/2019 Miller et al.
2019/0352982 A1 11/2019 Arefi et al.
2020/0032597 A1 1/2020 Jorgic et al.
2020/0040673 A1 2/2020 Donnally et al.
2020/0040674 A1 2/2020 Mckenzie et al.
2021/0246738 A1 8/2021 Mckenzie et al.
2021/0293099 A1 9/2021 Carnegie et al.
2021/0301602 A1 9/2021 Mckenzie et al.
2022/0145704 A1 5/2022 Mckenzie

FOREIGN PATENT DOCUMENTS

CN 108266139 A 7/2018
CN 110792399 A 2/2020
EP 1510302 A1 3/2005

(56) References Cited

FOREIGN PATENT DOCUMENTS

| | | | | | |
|---|---|---|---|---|---|
| EP | 1953334 | A2 | | 8/2008 | |
| GB | 639423 | A | * | 6/1950 | ..... E21B 19/14 |
| GB | 2091788 | A | | 8/1982 | |
| GB | 2532267 | A | | 5/2016 | |
| JP | H09-137689 | A | | 5/1997 | |
| NO | 149435 | B | * | 1/1984 | ..... E21B 19/14 |
| NO | 20151648 | A1 | | 12/2015 | |
| WO | WO-8800274 | A2 | | 1/1988 | |
| WO | WO-9958811 | A1 | | 11/1999 | |
| WO | WO-0123701 | A1 | | 4/2001 | |
| WO | WO-0179651 | A1 | * | 10/2001 | ..... E21B 19/14 |
| WO | WO-2004018829 | A1 | | 3/2004 | |
| WO | WO-2007143842 | A1 | | 12/2007 | |
| WO | WO-2013082172 | A1 | | 6/2013 | |
| WO | WO-2014179730 | A1 | | 11/2014 | |
| WO | WO-2015043740 | A1 | | 4/2015 | |
| WO | WO-2016024859 | A1 | | 2/2016 | |
| WO | WO-2016197255 | A1 | | 12/2016 | |
| WO | WO-2017039996 | A1 | | 3/2017 | |
| WO | WO-2017087595 | A1 | | 5/2017 | |
| WO | WO-2017190120 | A1 | | 11/2017 | |
| WO | WO-2017193204 | A1 | | 11/2017 | |
| WO | WO-2019195651 | A1 | | 10/2019 | |
| WO | WO-2020028852 | A1 | | 2/2020 | |
| WO | WO-2020028853 | A1 | | 2/2020 | |
| WO | WO-2020028853 | A9 | | 2/2020 | |
| WO | WO-2020028856 | A1 | | 2/2020 | |
| WO | WO-2020028858 | A1 | | 2/2020 | |
| WO | WO-2020151386 | A1 | | 7/2020 | |
| WO | WO-2020160440 | A1 | | 8/2020 | |
| WO | WO-2020172407 | A1 | | 8/2020 | |
| WO | WO-2021203122 | A1 | | 10/2021 | |
| WO | WO-2021226622 | A1 | | 11/2021 | |
| WO | WO-2022016168 | A1 | | 1/2022 | |
| WO | 2023081558 | | | 5/2023 | |

OTHER PUBLICATIONS

"U.S. Appl. No. 16/098,160, Advisory Action dated Aug. 10, 2021", 4 pgs.
"U.S. Appl. No. 16/098,160, Corrected Notice of Allowability dated Mar. 25, 2022", 4 pgs.
"U.S. Appl. No. 16/098,160, Examiner Interview Summary dated Jun. 23, 2020", 3 pgs.
"U.S. Appl. No. 16/098,160, Final Office Action dated Apr. 30, 2020", 7 pgs.
"U.S. Appl. No. 16/098,160, Final Office Action dated May 27, 2021", 8 pgs.
"U.S. Appl. No. 16/098,160, Non Final Office Action dated Sep. 15, 2021", 8 pgs.
"U.S. Appl. No. 16/098,160, Non Final Office Action dated Sep. 30, 2019", 8 pgs.
"U.S. Appl. No. 16/098,160, Non Final Office Action dated Oct. 6, 2020", 8 pgs.
"U.S. Appl. No. 16/098,160, Notice of Allowance dated Feb. 3, 2022", 7 pgs.
"U.S. Appl. No. 16/098,160, Preliminary Amendment filed Nov. 1, 2018", 5 pgs.
"U.S. Appl. No. 16/098,160, Response filed Jan. 6, 2021 to Non Final Office Action dated Oct. 6, 2020", 7 pgs.
"U.S. Appl. No. 16/098,160, Response filed Jan. 30, 2020 to Non Final Office Action dated Sep. 30, 2019", 8 pgs.
"U.S. Appl. No. 16/098,160, Response filed Jun. 30, 2020 to Final Office Action dated Apr. 30, 2020", 8 pgs.
"U.S. Appl. No. 16/098,160, Response filed Jul. 27, 2021 to Final Office Action dated May 27, 2021", 9 pgs.
"U.S. Appl. No. 16/098,160, Response filed Aug. 24, 2020 to Advisory Action dated Jul. 22, 2020", 9 pgs.
"U.S. Appl. No. 16/098,160, Response filed Aug. 27, 2021 to Advisory Action dated Aug. 10, 2021", 8 pgs.
"U.S. Appl. No. 16/098,160, Response filed Dec. 14, 2021 to Non Final Office Action dated Sep. 15, 2021", 8 pgs.
"U.S. Appl. No. 16/375,927, Advisory Action dated Aug. 11, 2020", 6 pgs.
"U.S. Appl. No. 16/375,927, Corrected Notice of Allowability dated Jan. 26, 2021", 2 pgs.
"U.S. Appl. No. 16/375,927, Examiner Interview Summary dated Apr. 24, 2020", 3 pgs.
"U.S. Appl. No. 16/375,927, Examiner Interview Summary dated Dec. 7, 2020", 7 pgs.
"U.S. Appl. No. 16/375,927, Final Office Action dated Jun. 5, 2020", 10 pgs.
"U.S. Appl. No. 16/375,927, Non Final Office Action dated Feb. 28, 2020", 9 pgs.
"U.S. Appl. No. 16/375,927, Non Final Office Action dated Sep. 24, 2020", 10 pgs.
"U.S. Appl. No. 16/375,927, Notice of Allowance dated Jan. 1, 2021", 8 pgs.
"U.S. Appl. No. 16/375,927, Response filed May 27, 2020 to Non Final Office Action dated Feb. 28, 2020", 10 pgs.
"U.S. Appl. No. 16/375,927, Response filed Aug. 3, 2020 to Final Office Action dated Jun. 5, 2020", 11 pgs.
"U.S. Appl. No. 16/375,927, Response filed Sep. 8, 2020 to Advisory Action dated Aug. 11, 2020", 10 pgs.
"U.S. Appl. No. 16/375,927, Response filed Dec. 16, 2020 to Non Final Office Action dated Sep. 24, 2020", 8 pgs.
"U.S. Appl. No. 16/431,533, Non Final Office Action dated Feb. 14, 2022", 15 pgs.
"U.S. Appl. No. 16/431,540, Examiner Interview Summary dated Jan. 19, 2021", 3 pgs.
"U.S. Appl. No. 16/431,540, Final Office Action dated Nov. 19, 2020", 10 pgs.
"U.S. Appl. No. 16/431,540, Non Final Office Action dated Jun. 10, 2020", 13 pgs.
"U.S. Appl. No. 16/431,540, Notice of Allowance dated Feb. 11, 2021", 5 pgs.
"U.S. Appl. No. 16/431,540, Response filed Jan. 19, 2021 to Final Office Action dated Nov. 19, 2020", 11 pgs.
"U.S. Appl. No. 16/431,540, Response Filed Sep. 10, 2020 to Non Final Office Action dated Jun. 10, 2020", 24 pgs.
"U.S. Appl. No. 16/431,540, Supplemental Notice of Allowability dated Mar. 11, 2021", 2 pgs.
"U.S. Appl. No. 16/786,345, Non Final Office Action dated Mar. 28, 2022", 13 pgs.
"U.S. Appl. No. 16/836,365, Final Office Action dated May 4, 2021", 7 pgs.
"U.S. Appl. No. 16/836,365, Non Final Office Action dated Jan. 25, 2021", 8 pgs.
"U.S. Appl. No. 16/836,365, Notice of Allowance dated Jul. 27, 2021", 7 pgs.
"U.S. Appl. No. 16/836,365, Notice of Allowance dated Nov. 3, 2021", 7 pgs.
"U.S. Appl. No. 16/836,365, Response filed Apr. 22, 2021 to Non Final Office Action dated Jan. 25, 2021", 8 pgs.
"U.S. Appl. No. 16/836,365, Response filed Jul. 2, 2021 to Final Office Action dated May 4, 2021", 7 pgs.
"U.S. Appl. No. 17/248,669, 312 Amendment filed Mar. 2, 2022", 3 pgs.
"U.S. Appl. No. 17/248,669, Examiner Interview Summary dated Dec. 17, 2021", 2 pgs.
"U.S. Appl. No. 17/248,669, Non Final Office Action dated Oct. 5, 2021", 8 pgs.
"U.S. Appl. No. 17/248,669, Notice of Allowability dated Feb. 3, 2022", 5 pgs.
"U.S. Appl. No. 17/248,669, Notice of Allowance dated Jan. 25, 2022", 8 pgs.
"U.S. Appl. No. 17/248,669, PTO Response to Rule 312 Communication dated Mar. 9, 2022", 2 pgs.
"U.S. Appl. No. 17/248,669, Response filed Jan. 5, 2022 to Non Final Office Action dated Oct. 5, 2021", 8 pgs.
"Canadian Application Serial No. 3,022,888, Voluntary Amendment filed Jul. 12, 2019", 10 pgs.

(56) References Cited

OTHER PUBLICATIONS

"International Application Serial No. PCT/CA2017/000125, International Preliminary Report on Patentability dated Nov. 22, 2018", 6 pgs.
"International Application Serial No. PCT/CA2017/000125, International Search Report dated Aug. 14, 2017", 3 pgs.
"International Application Serial No. PCT/CA2017/000125, Written Opinion dated Aug. 14, 2017", 4 pgs.
"International Application Serial No. PCT/CN2019/124443, International Preliminary Report on Patentability dated May 26, 2021", 4 pgs.
"International Application Serial No. PCT/CN2019/124443, International Search Report dated Mar. 5, 2020", 4 pgs.
"International Application Serial No. PCT/CN2019/124443, Written Opinion dated Mar. 5, 2020", 4 pgs.
"International Application Serial No. PCT/US2019/025942, International Preliminary Report on Patentability dated Oct. 30, 2020", 7 pgs.
"International Application Serial No. PCT/US2019/025942, International Search Report dated Jun. 27, 2019", 4 pgs.
"International Application Serial No. PCT/US2019/025942, Response filed Feb. 5, 2020 to Written Opinion dated Feb. 27, 2019", 14 pgs.
"International Application Serial No. PCT/US2019/025942, Response filed Apr. 23, 2020 to Written Opinion dated Apr. 23, 2020", 14 pgs.
"International Application Serial No. PCT/US2019/025942, Response filed Sep. 22, 2020 to Written Opinion dated Jul. 23, 2020", 4 pgs.
"International Application Serial No. PCT/US2019/025942, Written Opinion dated Feb. 24, 2020", 8 pgs.
"International Application Serial No. PCT/US2019/025942, Written Opinion dated Jun. 27, 2019", 9 pgs.
"International Application Serial No. PCT/US2019/025942, Written Opinion dated Jul. 23, 2020", 5 pgs.
"International Application Serial No. PCT/US2019/044974, International Preliminary Report on Patentability dated Nov. 11, 2020", 7 pgs.
"International Application Serial No. PCT/US2019/044974, International Search Report dated Oct. 24, 2019", 6 pgs.
"International Application Serial No. PCT/US2019/044974, Response filed Jun. 2, 2020 to Written Opinion dated Oct. 24, 2019", 13 pgs.
"International Application Serial No. PCT/US2019/044974, Response filed Aug. 18, 2020 to Written Opinion dated Jun. 19, 2020", 4 pgs.
"International Application Serial No. PCT/US2019/044974, Written Opinion dated Jun. 19, 2020", 7 pgs.
"International Application Serial No. PCT/US2019/044974, Written Opinion dated Oct. 24, 2019", 6 pgs.
"International Application Serial No. PCT/US2019/044976, International Search Report dated Oct. 18, 2019", 5 pgs.
"International Application Serial No. PCT/US2019/044976, Response filed Jun. 3, 2020 to Written Opinion dated Oct. 18, 2019", 11 pgs.
"International Application Serial No. PCT/US2019/044976, Response filed Aug. 25, 2020 to Written Opinion dated Jun. 26, 2020", 3 pgs.
"International Application Serial No. PCT/US2019/044976, Written Opinion dated Jun. 26, 2020", 4 pgs.
"International Application Serial No. PCT/US2019/044976, Written Opinion dated Oct. 18, 2019", 8 pgs.
"International Application Serial No. PCT/US2019/044976, Written Opinion dated Nov. 6, 2020", 6 pgs.
"International Application Serial No. PCT/US2019/044979, International Preliminary Report on Patentability dated Nov. 18, 2020", 7 pgs.
"International Application Serial No. PCT/US2019/044979, International Search Report dated Oct. 22, 2019", 6 pgs.
"International Application Serial No. PCT/US2019/044979, Response filed Jun. 3, 2020 to Written Opinion dated Oct. 22, 2019", 12 pgs.
"International Application Serial No. PCT/US2019/044979, Response filed Aug. 25, 2020 to Written Opinion dated Jun. 26, 2020", 3 pgs.
"International Application Serial No. PCT/US2019/044979, Written Opinion dated Jun. 26, 2020", 4 pgs.
"International Application Serial No. PCT/US2019/044979, Written Opinion dated Oct. 22, 2019", 7 pgs.
"International Application Serial No. PCT/US2019/044983, International Preliminary Report on Patentability dated Feb. 18, 2021", 8 pgs.
"International Application Serial No. PCT/US2019/044983, International Search Report dated Oct. 22, 2019", 5 pgs.
"International Application Serial No. PCT/US2019/044983, Written Opinion dated Oct. 22, 2019", 6 pgs.
"International Application Serial No. PCT/US2019/124443, Response filed Nov. 24, 2020 to Written Opinion dated Mar. 5, 2020", 10 pgs.
"International Application Serial No. PCT/US2020/019039, International Preliminary Report on Patentability dated Sep. 2, 2021", 6 pgs.
"International Application Serial No. PCT/US2020/019039, International Search Report dated May 15, 2020", 2 pgs.
"International Application Serial No. PCT/US2020/019039, Written Opinion dated May 15, 2020", 4 pgs.
"International Application Serial No. PCT/US2021/070319, International Search Report dated May 31, 2021", 5 pgs.
"International Application Serial No. PCT/US2021/070319, Written Opinion dated May 31, 2021", 6 pgs.
"International Application Serial No. PCT/US2021/070488, International Search Report dated Sep. 8, 2021", 4 pgs.
"International Application Serial No. PCT/US2021/070488, Invitation to Pay Additional Fees dated Jun. 28, 2021", 2 pgs.
"International Application Serial No. PCT/US2021/070488, Written Opinion dated Sep. 8, 2021", 6 pgs.
"International Application Serial No. PCT/US2021/070786, International Search Report dated Nov. 9, 2021", 4 pgs.
"International Application Serial No. PCT/US2021/070786, Invitation to Pay Additional Fees dated Sep. 1, 2021", 2 pgs.
"International Application Serial No. PCT/US2021/070786, Written Opinion dated Nov. 9, 2021", 7 pgs.
"International Application Serial No. PCT/US2022/070377, International Search Report dated Mar. 25, 2022", 5 pgs.
"International Application Serial No. PCT/US2022/070377, Written Opinion dated Mar. 25, 2022", 7 pgs.
"Moveit—Kinematic constraints: Visibility Constraint Class Reference", [online]. [retrieved Apr. 21, 2021]. Retrieved from the Internet: <URL: http://docs.ros.org/en/hydro/api/moveit_core/html/classkinematic_constraints_1_1VisibilityConstraint.html>, (2021), 8 pgs.
"Moveit—Moving robots into the future", [online]. [archived Dec. 4, 2020]. Retrieved from the Internet: <URL: https://web.archive.org/web/20201204224545/https://moveit.ros.org/>, (2020), 7 pgs.
"Saudia Arabian Application No. 521421161, Office Action dated Apr. 4, 2022", (w/ English Summary), 6 pgs.
"International Application Serial No. PCT/US2022/077150, International Search Report dated Nov. 28, 2022", 5 pgs.
"International Application Serial No. PCT/US2022/077150, Written Opinion dated Nov. 28, 2022", 6 pgs.

* cited by examiner

PASSIVE SPACER SYSTEM

FIELD OF THE INVENTION

The present disclosure relates to an organizing system for tubulars on a drill rig. More particularly, the present disclosure relates to a jig, holder, rack, or other organizing system adapted to control the position of the top end of tubulars arranged in a setback area of a drill rig. Still more particularly, the present disclosure relates to a spacing mechanism incorporated into a racking board of a drill rig to control the spacing and, thus, the position of the top ends of tubulars arranged in the setback area.

BACKGROUND OF THE INVENTION

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

Tubulars on a drill rig may be placed in a setback area of the drill rig when first creating the pipe stands for a drilling operation, when tripping drill pipe out of a well, or in other circumstances. When the well is being drilled or when otherwise tripping pipe into the well, the pipe stands may be picked from the setback area and added to the drill string as the drill string is fed into the wellbore. As such, the setback area may be loaded and unloaded from time to time throughout drilling operations.

When drill pipe, pipe stands, or other tubulars are loaded into the setback area, they may be set in selected positions within the setback area on the drill floor and the tops of the tubulars may be guided into a racking board or finger board. The racking board or finger board may include a rack arranged high above the drill floor that includes a series of slots for placing the tops of the tubulars. Each slot may be arranged to hold a row of tubulars, for example, and the tubulars may be placed so that they lean away from well center and toward the back end of the slots to help keep each row of tubulars supported and stationary. The slots in the racking board may be larger than the diameter of the tubulars and may be sized to accommodate varying diameters of tubulars including various diameters of drill pipe and various diameters of drill collar, for example. As such, when the tubulars are placed in the slots, the tubulars may tend to nest alongside one another and rotate around the top of adjacent tubulars similar to several shovel/rake/broom handles stacked in a corner. This somewhat tangled arrangement of tubulars may make it difficult to free the tubulars from the racking board, More particularly, when using robotics, the position of the top end of the tubulars may be relatively unknown and difficult to find with a programmed robotic pipe handling device. For example, where a series of 10 six-inch pipes are anticipated to be arranged alongside one another, the first pipe may be thought to be 60 inches, or so, from the back of the racking board slot. However, where each pipe is nested in against an adjacent pipe, the first pipe may vary from its anticipated position by several inches and potentially up to 8-12 inches from its anticipated location.

BRIEF SUMMARY OF THE INVENTION

The following presents a simplified summary of one or more embodiments of the present disclosure in order to provide a basic understanding of such embodiments. This summary is not an extensive overview of all contemplated embodiments and is intended to neither identify key or critical elements of all embodiments, nor delineate the scope of any or all embodiments.

In one or more embodiments, a passive spacer system may include a racking board comprising a slot and a spacer arranged along the slot such that a portion of the spacer impinges on the slot. The spacer may be biased in a neutral position and configured to move to a spacing position due to motion of tubulars into and out of the racking board, which interact with the portion of the spacer that impinges on the slot.

In one or more embodiments, a passive spacer system may include a frame adapted for securing to a finger of a racking board and adjacent a slot. The system may also include a spacer pivotally arranged on the frame such that when the frame is positioned adjacent the slot, a portion of the spacer impinges on the slot. The spacer may be biased in a neutral position and configured to move to a spacing position due to motion of tubulars into and out of the racking board, which interact with the portion of the spacer that impinges on the slot.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to a passive spacer system for controlling the relative position of tubulars arranged in a racking board on a drill rig. The system may be adapted to maintain the relative spacing of the tubulars in the racking board by preventing adjacent tubulars from nesting around one another, for example. Moreover, the system may be passive and avoid the need for electrical, hydraulic, pressurized air, or other power for operation. As such, a respective power source and power lines such as electrical lines, hydraulic lines, air lines, or other power transport lines may not be necessary for operation of the system. The passive spacer system may provide for an organized arrangement of tubulars in the setback area that are more readily accessible by personnel or robotics at or near the racking board due to the spacing between the tubulars. Moreover, in the case of robotic handlers, the position of the top of each tubular in the racking board may be more consistent allowing for engagement by a robotic handler more readily.

Figure 1:
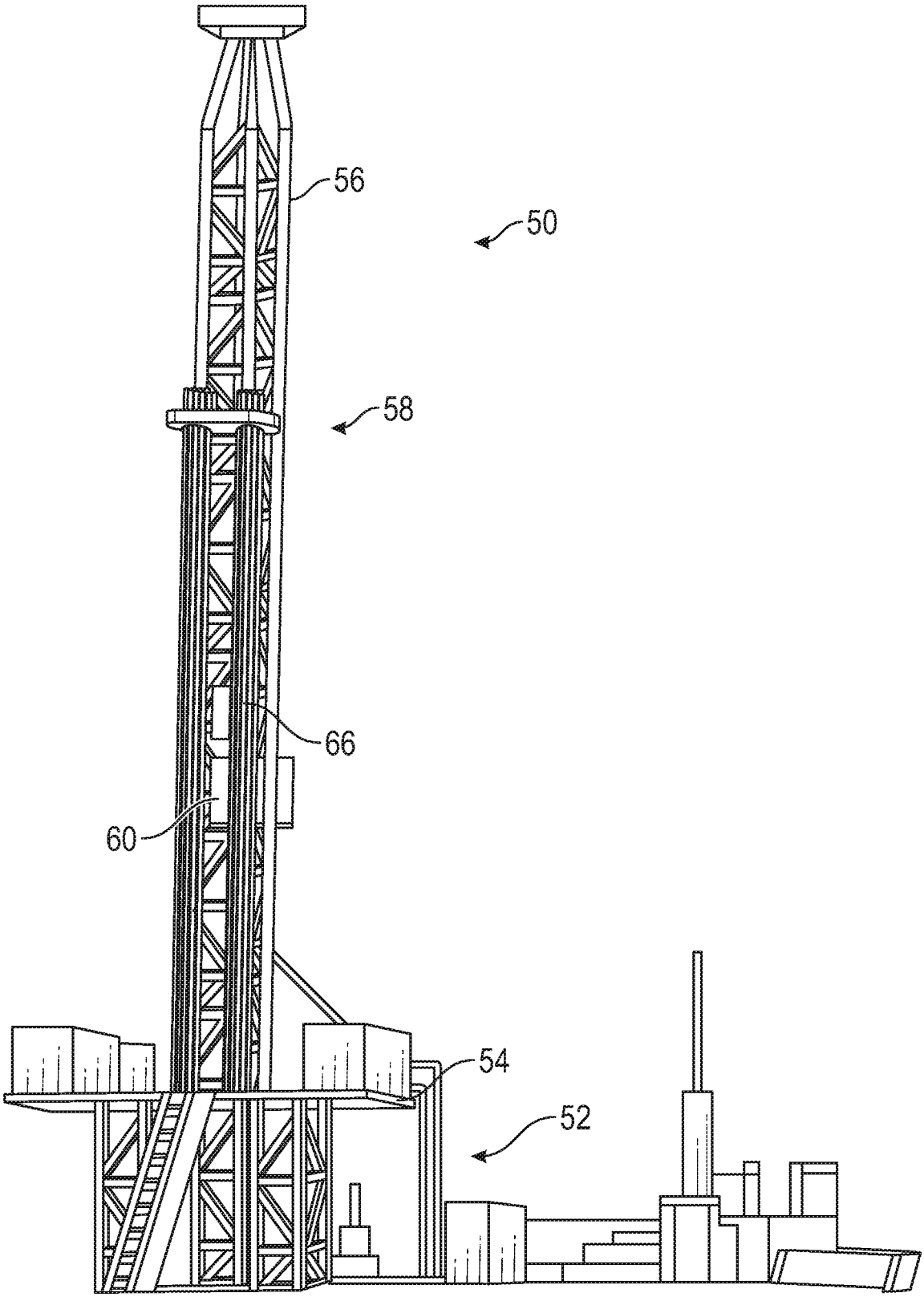
FIG. 1 is a front perspective view of a drill rig having a racking board with a passive spacer system, according to one or more embodiments.
Figure 2:
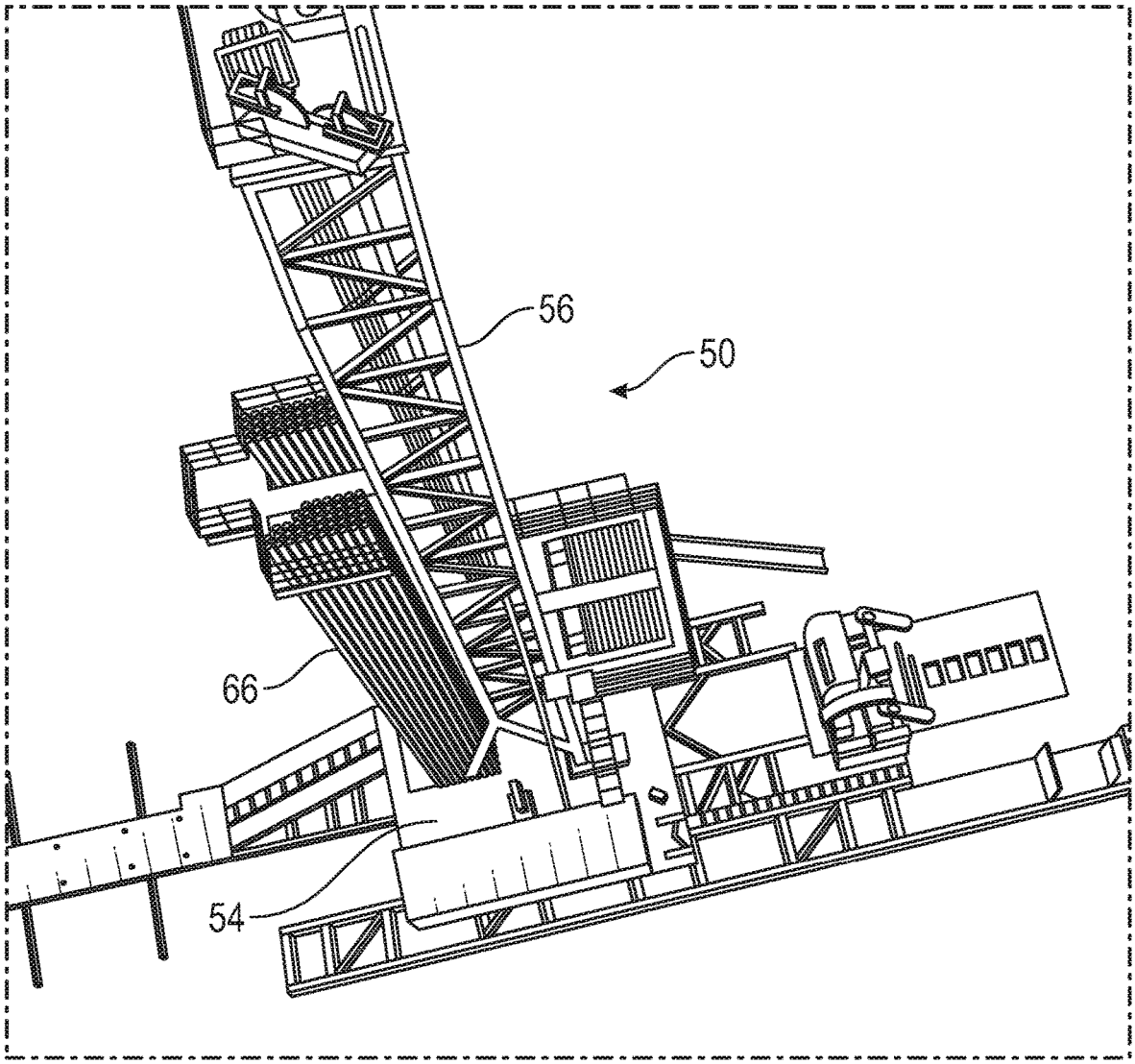
FIG. 2 is a top side perspective view of the drill rig of FIG. 1, according to one or more embodiments.

FIG. 1 is an elevation view of a drill rig 50 having a passive spacer system 100, according to one or more embodiments. As shown, the drill rig 50 may include a support structure 52 supporting a drill floor 54 and a mast 56. The drill rig 50 may include a racking board 58 extending laterally from the mast 56. In one or more embodiments, robotic pipe handlers may be arranged on the drill floor and at the racking board or human pipe handlers may be present. The drill rig 50 may include a top drive 60 with a pipe elevator. The top drive 60, top drive elevator and the robotic handlers may operate in a coordinated tripping process to trip drill pipe or other tubulars 66 into and out of a well bore. As shown in FIG. 2, tubulars 66 in the form of pipe stands made up of two to three lengths of drill pipe may be assembled and arranged in a setback area. The pipe stands may rest on a setback area of the drill floor and extend upward and through the racking board 58, where each row of pipe stands is arranged in a slot of the racking board 58 formed by a series of fingers.

Figure 3:
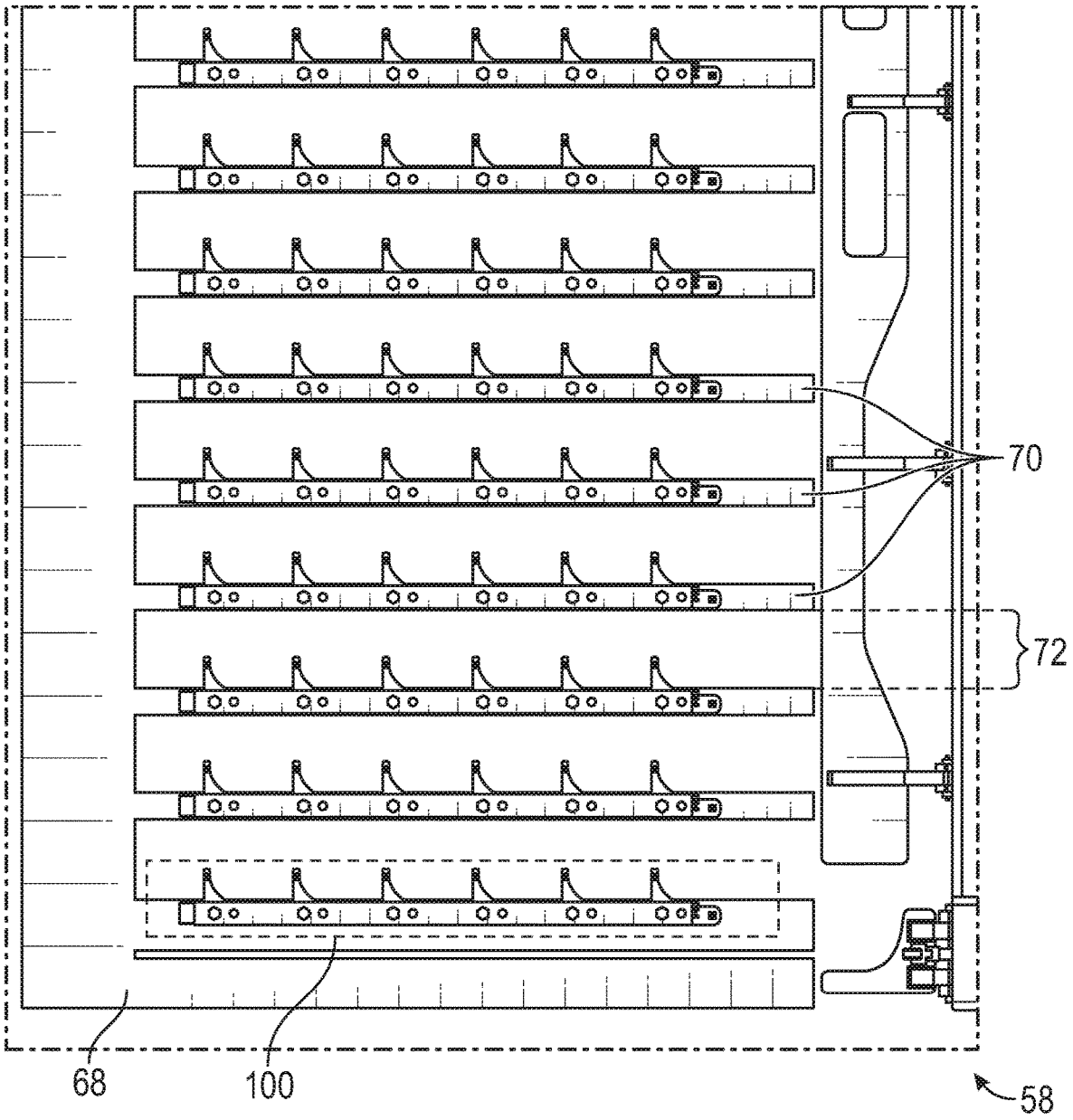
FIG. 3 is a top view of a racking board of the drill rig of FIGS. 1 and 2 showing the passive spacer system, according to one or more embodiments.

Turning now to FIG. 3, a top-down view of a portion of a racking board 58 is shown. The racking board 58 may be configured to laterally support the tops of the tubulars arranged in the setback area. As shown, the racking board 58 may include a frame structure 68 that extends laterally from the mast along an outboard side of the setback area and a series of fingers 70 may extend from the frame structure 68 and across the setback area forming slots 72 between the fingers 70. The slots may be sized to receive several tubulars 66 and, as such, may have widths ranging from approximately 6 inches to approximately 10 inches and lengths ranging from approximately 30 inches to approximately 72 inches. The size of the racking board 68 may correspond with the size of the drill rig and the size of the setback area provided. Without more, the racking board 58 may function to receive the top ends of tubulars 66 where the bottoms of the tubulars are placed on the drill floor 54 within the setback area and the top ends of the tubulars 66 are placed in the slots 72 and leaned toward the back of the slots 72. However, as mentioned, the top ends of the tubulars 66 may nest around each other, particularly where the slot width is relatively large relative to the tubular size.

With continued reference to FIG. 3, and to address the problem of nesting tubulars, the racking board 58 may be equipped with a passive spacer system 100. The passive spacer system 100 may be configured to control the spacing between the top ends of the tubulars 66 in the racking board 58, preventing the tubulars 66 from nesting around each other and, thus, providing a consistent location for the top end of each of the tubulars 66 positioned in the setback area. As shown in FIGS. 4-7, the passive spacer system 100 may include a frame 102 and a series of spacer assemblies 104 arranged along the length of the frame.

The frame 102 may be configured for arrangement on a finger 70 of the racking board 58 to hold the spacer assemblies 104 in spaced apart position along the length of the fingers 70 and the corresponding slots 72. As shown, the frame 102 may be a ladder type frame 102 with upper and lower runners 106A/106B having spindles 108 extending therebetween at each of the spacer assembly positions. The upper and lower runners 106A/106B may include relatively rigid elongate elements such as bars, tubes, or other relatively rigid, long, and slender elements.

The spindles 108 may extend generally orthogonally between the upper and lower runners 106A/106B and may be adapted to sleevably receive the spacer assemblies 104. The spindles 108 may be generally cylindrically shaped to allow for rotation of the spacer, biasing mechanisms, or other items sleevably arranged thereon. The spindle 108 may include a hollow cylinder secured to the bottom runner 106B by welding, for example, and secured to the top runner with a bolt extending through the top runner and into the spindle 108. For this purpose, the upper end of the spindle may include threads on an inner surface thereof. The spindle 108 may, alternatively, be secured to the top runner by welding and be bolted to the bottom runner or bolted to both the top and bottom runner. Still other methods of fastening the spindles between the runners may be used. For example, the spindle may include a shoulder bolt or other fastener extending through the top/bottom runners 106A/B. The spindle may extend generally orthogonally between the upper and lower runners and may define an axis of rotation of one or more aspects of the spacer assembly 104.

The frame 102 may also include one or more frame posts 110 configured to assist a biasing mechanism of the spacer assemblies 104 in performing a centering function for the spacers (e.g., a function of returning the spacer to a neutral position). As shown, the one or more frame posts 110 may extend away from a respective upper or lower runner 106A/106B generally parallel with, but spaced apart from, a respective spindle 108. The frame posts 110 may cantilever upward or downward from a respective runner 106A/106B toward an opposing runner (e.g., in a same direction as the spindle), That is, the frame posts 110 may be rigidly secured to the runner 106A/106B and extend upward or downward therefrom and resist tipping, bending, or other deformation. In one or more embodiments, the frame posts 110 may threadably engage the runner 106A/106B, or otherwise extend through the runner 106A/106B. In one or more embodiments, the frame posts 110 may be welded to the runner 106A/106B. The frame posts 110 may extend away from the runner 106A/106B and may include an enlarged crown, onion dome, flange, or other enlarged end portion adapted to prevent prongs of the biasing mechanism from slipping off the end of the frame post 110.

It is to be appreciated that while upper and lower runners 106A/106B have been provided, one or more embodiments may include a single sided frame 102 having spindles 108 and frame posts 110 extending upward or downward therefrom. Still further, integration of the upper and/or lower runners 106A/106B into an existing racking board 58 may also be provided, where, for example, the finger 70 of the racking board serves as the upper or lower runner 106A/106B, for example, and the spindle 108 and frame posts 110 extend in an upward or downward direction from the finger 70 of the racking board 58. Still other approaches to providing a framework for the spacer assemblies 104 may be provided.

Figure 8:
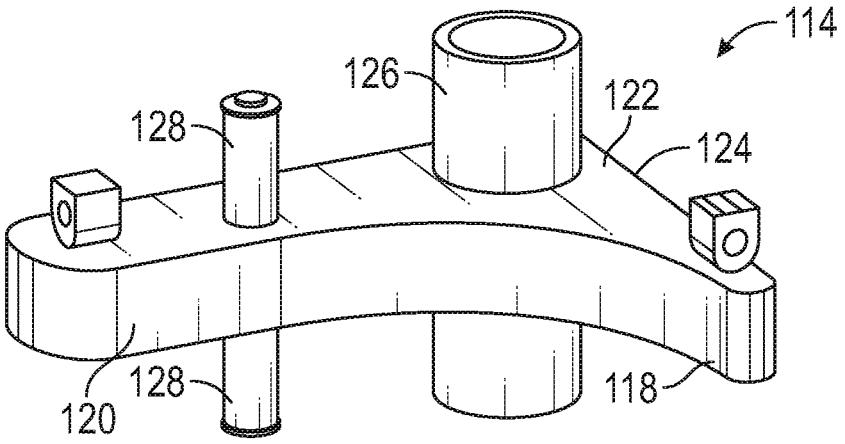
FIG. 8 is an isolated perspective view of a single spacer from the passive spacer system of FIGS. 4-7, according to one or embodiments.

With continued reference to FIGS. 4-7, the spacer assemblies 104 may include a spacer 112 and a biasing mechanism 116. The spacer 112 may be adapted to perform a spacing operation where actuation is automatically performed due to the motion of the tubulars 66 into and out of the racking board 56. A spacer 112 is shown in isolation in FIG. 8. As shown, the spacers 112 may include a generally L-shaped element having a toe 118 configured for catching on a tubular 66 when a tubular 66 is placed in the racking board 56 or removed from the racking board 56 and a leg 120 configured for arrangement between the tubulars 66 in the racking board 56. Each of the leg 120 and the toe 118 may extend from a central body or heel portion 122 adapted to sleevably and pivotally engage a spindle 108 of the frame 102, The portion of the spacer 114 between the toe 118 and the heel 122 may form a foot having a bottom surface 124. However, as shown, the toe/heel/leg assembly may be arranged on its side, so to speak, with the bottom 124 of the foot directed toward an inward portion of the racking board slots 72 (e.g., toward the end of the slots 72 against which the tubulars 66 lean). The frame 102 may be arranged on the fingers 70 of the racking board 56, as mentioned above, and the toe 118 may extend laterally from the frame 102 and into the slots 72 of the racking board 56. As the toe 118 extends away from the heel 122, the toe 118 may be tapered where a bottom side (e.g., anatomical bottom) of the toe 118 is generally flat and a top side (e.g., anatomical top) is curved in a concave fashion extending outward to a bullnose tip at the toe 118. The concave curvature of the toe 118 may continue inwardly along the central body portion 122 and upwardly (e.g., anatomical upward) giving way to a relatively flat front face of the leg portion 120. The leg portion 120 may have a thickness selected depending on the desired spacing of the tubulars 66 and may include generally flat front and back surfaces adapted to space the tubulars 66 from one another. The relatively flat front and back surfaces may extend upwardly (e.g., anatomically upward) to a bullnose top end of the leg 120 of the spacer 114.

The central body portion or heel 122 of the spacer 114 may include a spindle bushing 126 adapted to sleevably engage the spindles 108 and maintain the position of the toe 118, leg 120, and body portion 122 of the spacer 114 generally centered between the upper and lower runners 106A/106B. The spindle bushing 126 may also be adapted to provide a location for and/or avoid inhibiting operation of the biasing mechanism 116. As shown, the spindle bushing 126 may include a generally cylindrical element extending out the sides (e.g., anatomical sides) of the spacer 114 and through the body portion 122 of the spacer 114. It is to be appreciated that the bushing 126 may take the form of two separate parts arranged on each side of the body portion 122 where a bore extends through the body portion 122 with an inner diameter matching that of the bushing 126 or a bushing 126 may extend through the body portion 122. Either way, the bushing 126 and body portion 122 may be adapted to sleevably and slidably engage the spindle 108 to rotate substantially freely on the spindle 108 about the axis of rotation and while holding the body portion 122 generally centered or spaced from the upper and lower runners 106A/106B. The portions of the bushing 126 extending laterally away from the body portion 122 may be sized and adapted for sleevably receiving a biasing mechanism 116 discussed in more detail below.

The spacers 114 may also include spacer posts 128 adapted for engaging the biasing mechanism 116. As shown, the spacer posts 128 may extend laterally (anatomically lateral) out the sides of the legs 120 to engage prongs of the upper and lower biasing mechanisms 116. The spacer posts 128 may be cantilevered from the leg 120 and may extend through the leg 120 or be attached to the surface of the leg 120, but may be generally rigidly arranged to avoid tipping or bending or having other substantial deformation relative to their cantilevered position on the leg 120.

Figure 11A:
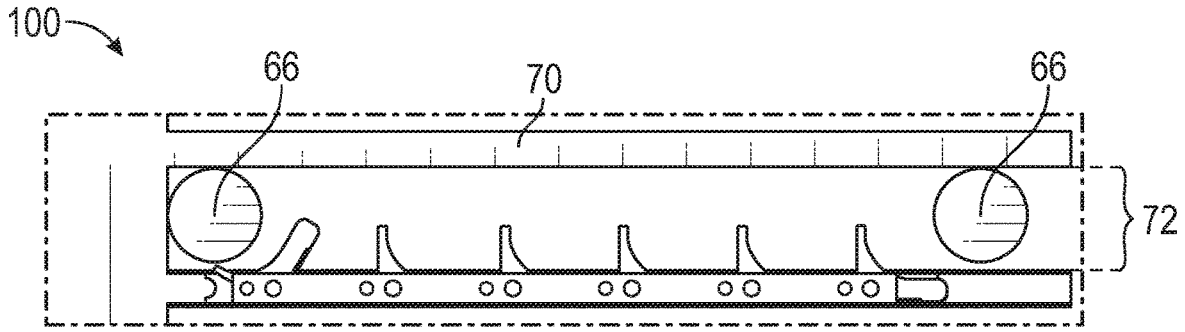
FIG. 11A is a top down view of a slot in a finger board with a passive spacer system showing a first pipe fully within the slot and an additional pipe entering the slot, according to one or more embodiments.

The spacers 114 may be spaced along the runners 106A/106B in particular positions relating to the size of the pipe being placed in the racking board. That is, as shown in FIGS. 1.1A-11E, the last spacer 114 nearest the end of the racking board slot 72 may be positioned such that a stopped tubular 66 in the end of the slot 72 maintains contact with the toe 118 of the spacer 114 so as to hold the spacer 114 in a rotated position (e.g., see FIG. 11A) The remaining spacers 114 may also be spaced such that a tubular 66 that is held in a position corresponding to that spacer 114 maintains the spacer 114 in a rotated position. (e.g., see FIG. 119 where second tubular maintains second spacer in rotated position). In one or more embodiments, the spindles 108 on the runners 106A/1069 may define the spacer spacing. The spacing may be determined by summing an outer tubular diameter with a gap dimension 130, which may be equal to the leg thickness, for example. The last spacer along the slot 70 (e.g., the one closest to the closed end of the slot) may be spaced from the end by the outside tubular diameter plus half of the gap dimension 130. Further discussion of this is included below with respect to FIGS. 11A-11E.

Figure 9:
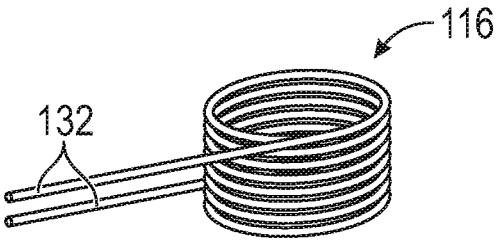
FIG. 9 is an isolated perspective view of a centralizing spring of a spacer assembly, according to one or more embodiments.
Figure 10:
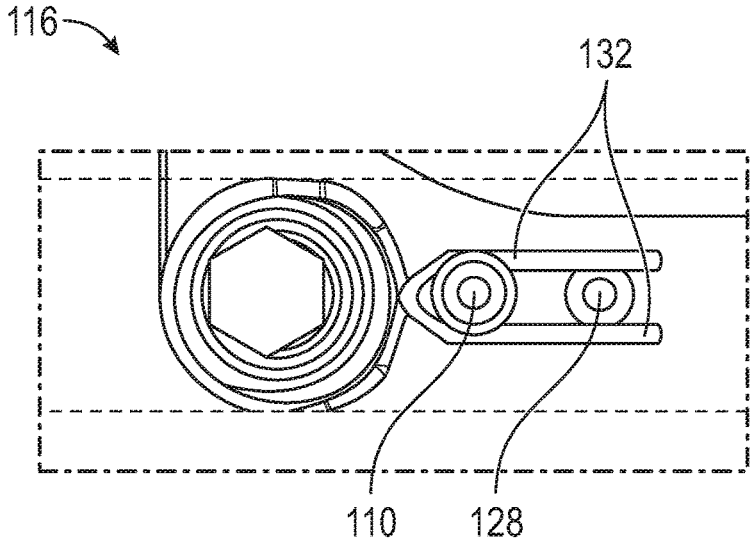
FIG. 10 is a top down view of the centralizing spring in place on a spacer assembly, according to one or more embodiments.
Figure 14:
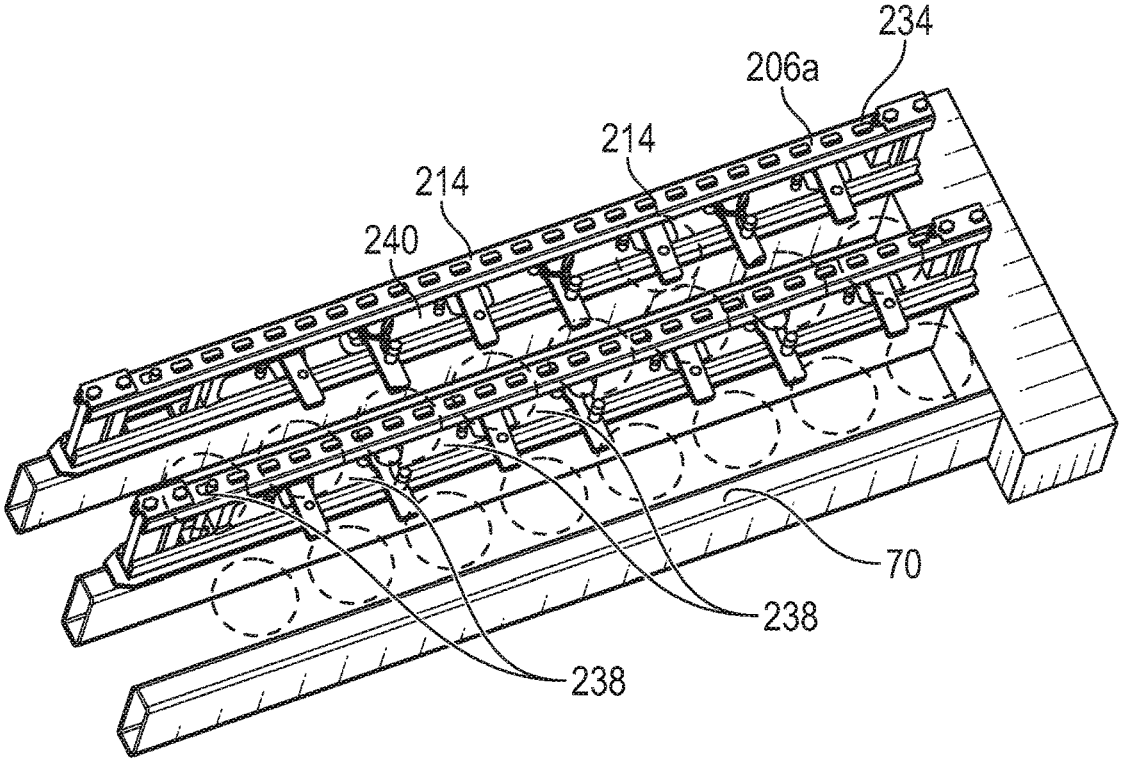
FIG. 14 is a perspective view thereof with the spacers in a spacing orientation.
Figure 15:
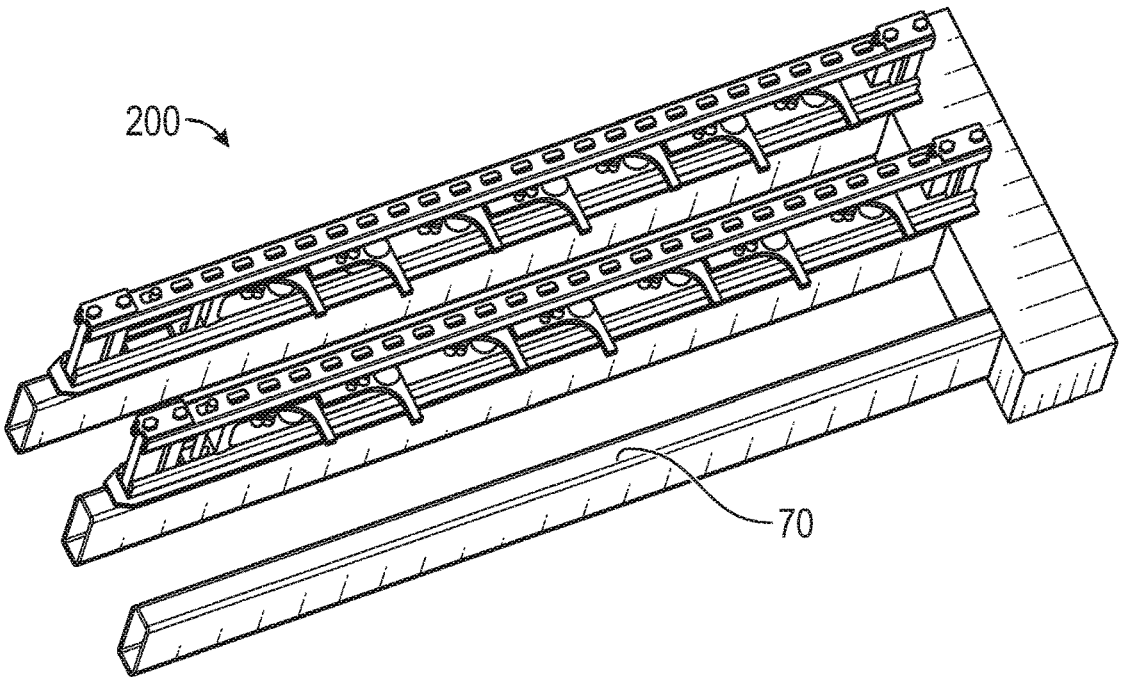
FIG. 15 is a perspective view thereof with the spacers in a neutral position.
Figure 16:
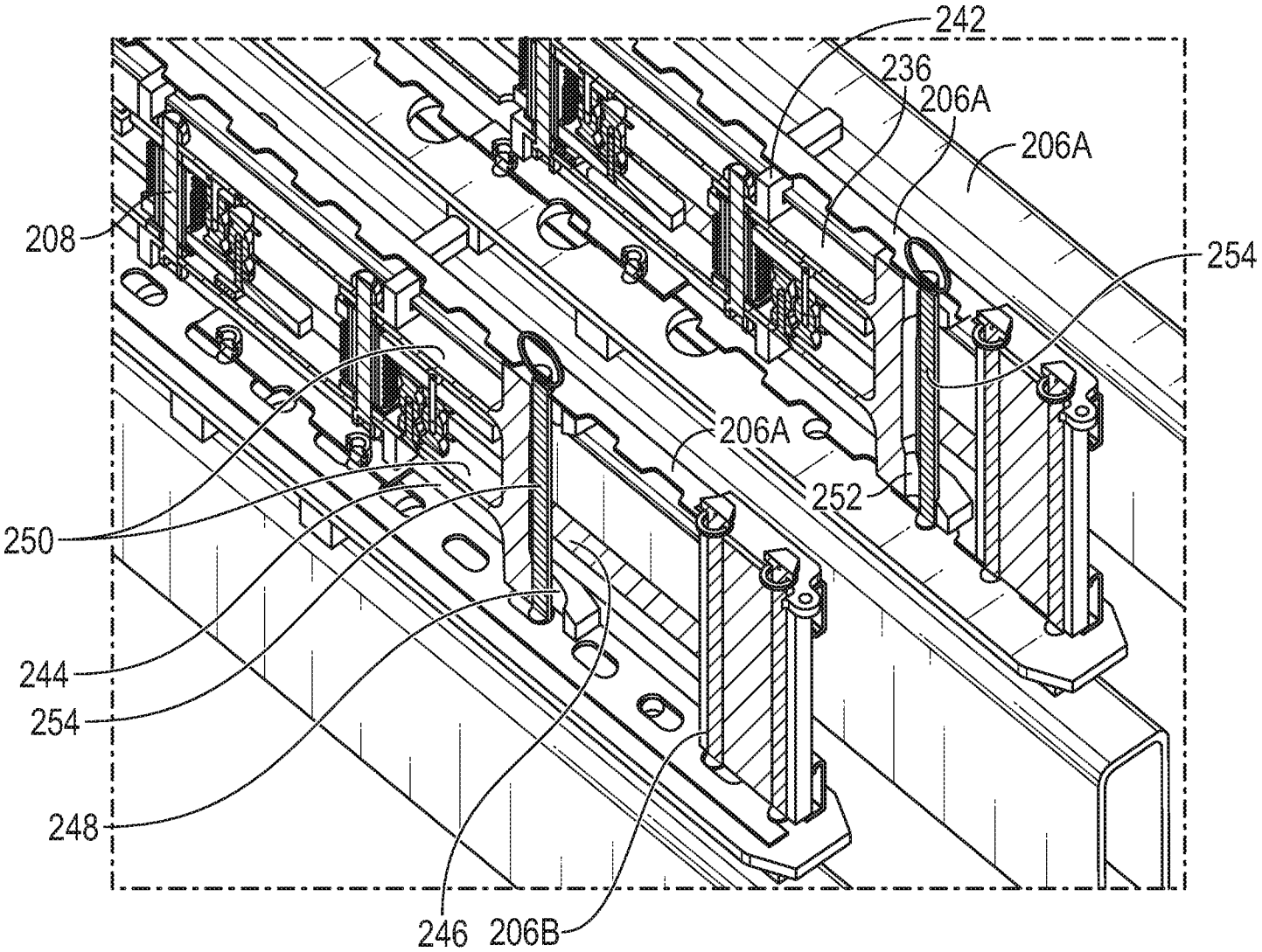
FIG. 16 is a perspective cross-sectional view of an adjustment link end of the adjustment mechanism, according to one or more embodiments.

Turning now to FIGS. 9 and 10, the biasing mechanism 116 of the spacer assemblies 104 are shown. The biasing mechanism 116 may be configured to provide a two-way biasing force on the spacer 114 such that forces causing the spacer to rotate in either direction (e.g., clockwise or counterclockwise) away from neutral are resisted and when external forces are not present, the spacer 114 stays or returns to a neutral position. As shown, the biasing mechanism 116 may include a centralizing spring. The centralizing spring may be sized to fit over the spacer bushing 126 relatively loosely to allow for constriction of the centralizing spring without binding on the spacer bushing 126. The centralizing spring may include prongs 132 extending from each end of the centralizing spring. The prongs 132 may each extend upwardly or downwardly, as the case may be (e.g., bottom one extends upwardly/top one extends downwardly), toward a mid-height of the centralizing spring. As shown from above in FIG. 10, the prongs 132 may cross paths and may extend laterally away from the coiled spring in parallel fashion. In extending parallel away from the coiled spring, the prongs 132 may be spaced apart from one another by a distance wide enough to accommodate the frame posts 110 on the runners and the spacer post 128 on the leg 120 of the spacer 114. The prongs 132 may also be spaced close enough to define a gap narrower than the crown, onion dome, flange, or other capping element on the runner frame posts 110. As shown, a biasing mechanism 116 may be provided above and below the spacer 114 and, as such, two biasing mechanisms for each spacer may be provided. Alternatively, as shown in FIGS. 14-16, a single biasing mechanism 216 may be provided on each spindle 208. Moreover, as shown, the spacers 214 may be staggered between high and low positions along the runners 206A/206B where, when the spacer 214 is in a high position, the biasing mechanism 216 is below the spacer 214 and when the spacer 214 is in a low position, the biasing mechanism 216 is above the spacer 214. It is to be appreciated that while a biasing mechanism in the form of a centralizing spring is shown, other biasing mechanisms such as torsion bars, elastic flaps, or other biasing mechanism adapted to perform a centralizing function may be provided.

As may be appreciated from a review of FIGS. 4-10, the rotation of the spacer 114 about the spindle 108 may cause a biasing force to build up in the spring and when the spacer 114 is released, the biasing force may rotate the spacer 114 back to a neutral position. In particular, and with reference to FIG. 5, when a force is applied to the toe 118 of the spacer 114 in a direction extending into the slot 72, the spacer 114 may rotate counterclockwise. In doing so, the spacer post 128 on the spacer 114 may press counterclockwise on the prong 132 nearest the slot 72. The prong 132 on the outboard side away from the slot 72 may engage the frame post 110 on the runner 106A/106B. As such, as the spacer 114 rotates counterclockwise, the centralizing spring may tighten and when the spacer 114 is released, the centralizing spring may return to a neutral position rotating the spacer post 128 on the spacer 114 clockwise and back into position adjacent the outboard prong 132. Similarly, when a force is applied to the toe 118 of the spacer 114 in a direction extending out of the slot 72, the spacer 114 may rotate clockwise. In doing so, the spacer post 128 on the spacer 114 may press clockwise on the prong 132 on the outboard side away from the slot 72. The inboard prong 132 may engage the frame post 110 on the runner 106A/106B. As such, as the spacer 114 rotates clockwise, the centralizing spring may tighten and when the spacer 114 is released, the centralizing spring may return to a neutral position rotating the spacer post 128 on the spacer 114 counterclockwise and back into position adjacent the inboard prong 132. In this manner, the spacer 114 may be moved out of a neutral position by tubulars 66 entering and exiting the racking board 56 and may attempt to return to a neutral position unless an obstruction prevents it from doing so.

Figure 4:
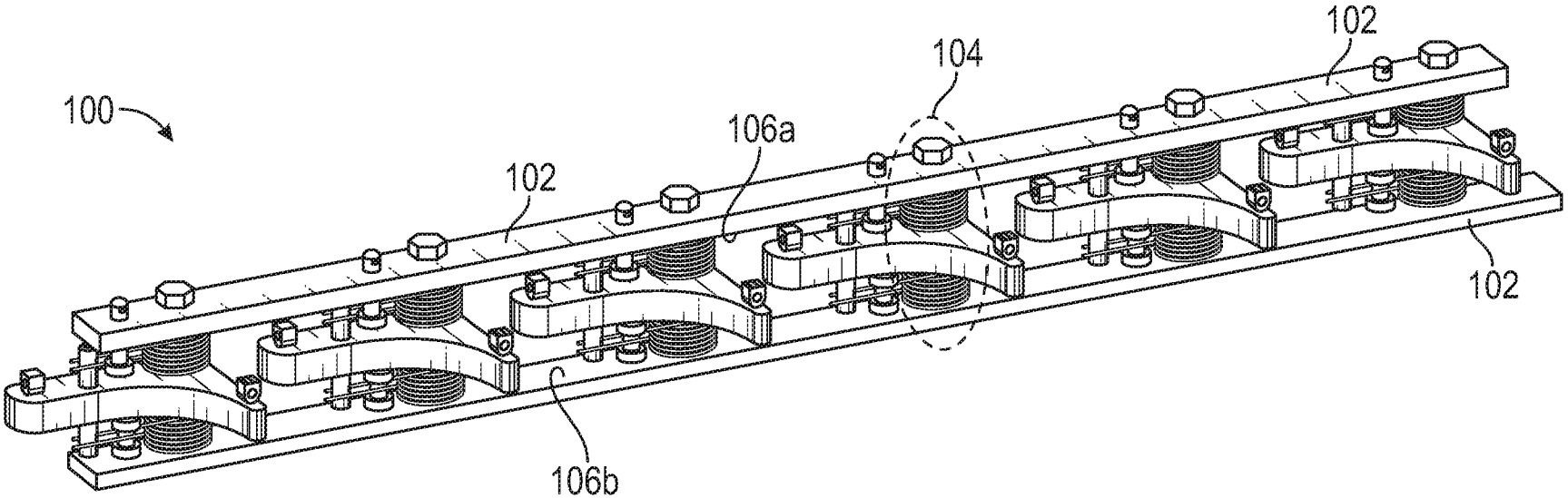
FIG. 4 is a perspective view of a finger of a racking board with a passive spacer system, according to one or more embodiments.
Figure 5:
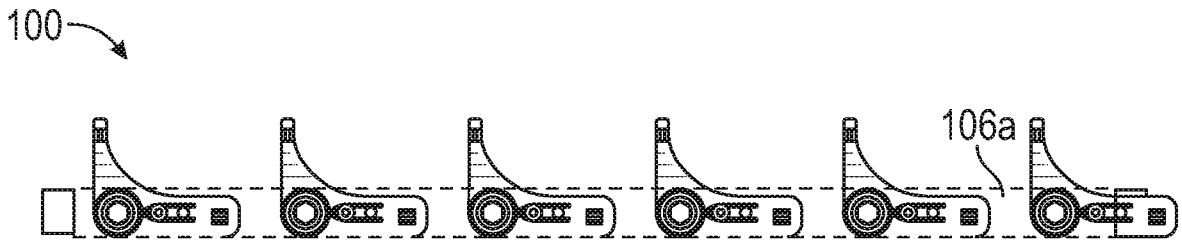
FIG. 5 is a top down, partially transparent, view thereof.
Figure 6:
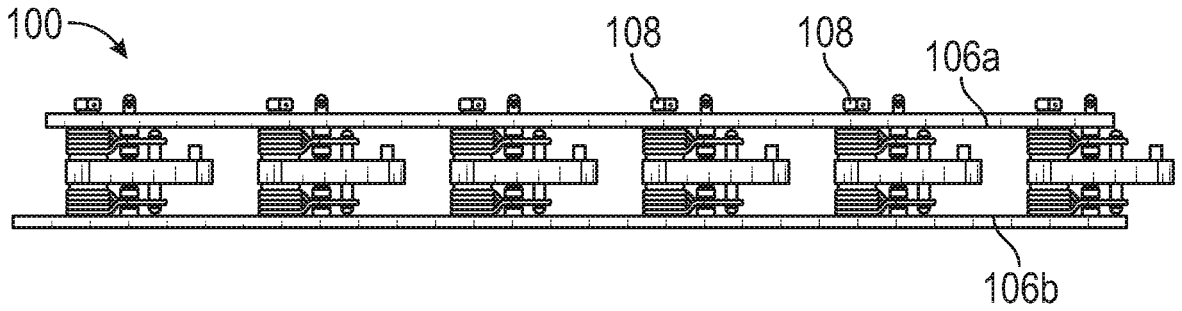
FIG. 6 is a side view thereof.
Figure 7:
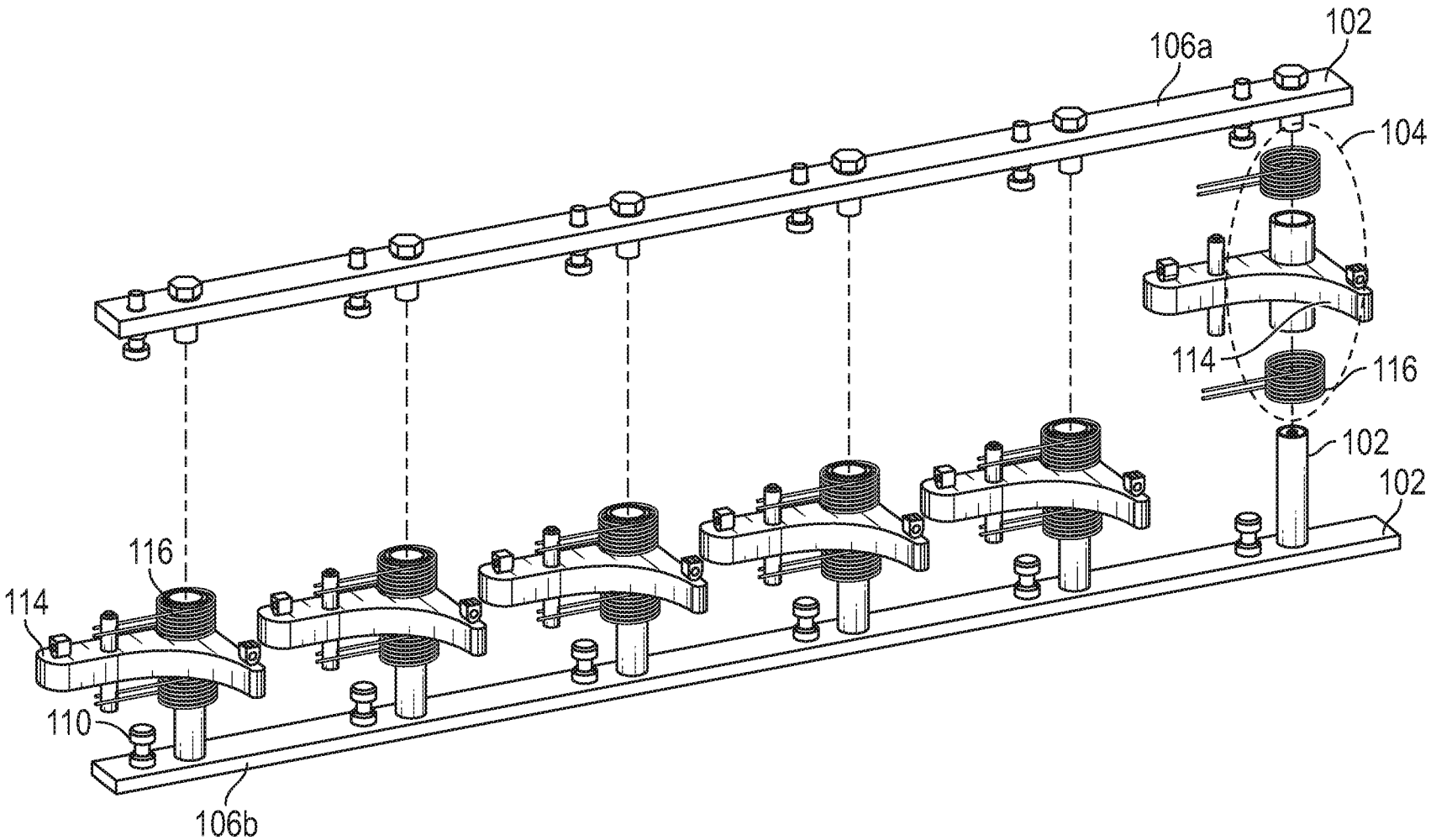
FIG. 7 is an exploded view thereof.

In an assembled condition, the spacers 114 may be arranged on the spindles 108 of the frame 102 and may have a leg 120 of the spacer 114 arranged generally parallel to the frame 102 or parallel to the fingers 70 of the racking board 56. The biasing mechanisms 116 may be arranged with the prongs 132 arranged on either side of the spacer post 128 and on either side of the frame posts 110 on the frame 102 as shown in FIGS. 4 and 5. In this position, when the frame 102 is arranged alongside a slot 72 in the racking board 56, the toe 118 of the spacer 114 may impinge or extend partially across the slot 72. This position of the toe 118 of the spacer 114 may allow the spacer to interact passively with the tubulars 66 as the tubulars 66 are moved along the corresponding slot 72 in the racking board 56, This passive interaction is discussed in more detail immediately below.

In operation and use, a method of operation 300 of a passive spacer system may be provided as illustrated by FIGS. 11A-E. That is a method 300 may include inserting a tubular into a slot of a racking board 302. As the tubular is moved into the slot, the tubular may contact the toe of the spacers arranged along the slot and continued motion of the tubular along the slot may rotate the spacers as the tubular passes by. Once the tubular passes fully by a particular spacer, the spacer may return to its neutral position. When the tubular reaches the end of the slot, the toe of the last spacer may maintain contact with the tubular as the tubular rests against the end of the slot. That is, the position of the last spacer and the toe length may be such that the toe of the spacer maintains contact with the tubular when it reaches the end of the slot. The last spacer may, thus, be held in a counterclockwise staging position by the tubular such that the leg of the last spacer extends into or impinges on the slot. The other spacers, being no longer in contact with the tubular, may have returned to their neutral position with the toe extending into the slot. The method may also include receiving a second tubular into the slot in the racking board 304. This step may include contacting the tubular with a toe of the spacers arranged along the slot wherein continued motion of the tubular along the slot rotates the spacers as the tubular passes by, Once the tubular passes fully by a particular spacer, the spacer may return to its neural position. When the tubular contacts the leg of the last spacer, the tubular may rotate the last spacer further counterclockwise bring the leg into position between the first tubular in the slot and the second tubular. As shown, this may "square up" the spacer causing the spacer to extend generally orthogonally across the slot and be arranged between the first and second tubular and in a spacing position and establishing the gap dimension between the tubulars. The second tubular may remain in contact with the toe of the second to last spacer and, thus, the second to last spacer may be held in a counterclockwise position with its leg extending across the slot. The other spacers, being no longer in contact with the tubular, may have returned to their neutral positions. The process may continue until the slot is full of tubulars 306 and each tubular is spaced from the next tubular by a gap dimension defined by the thickness of the spacer leg.

Figure 11B:
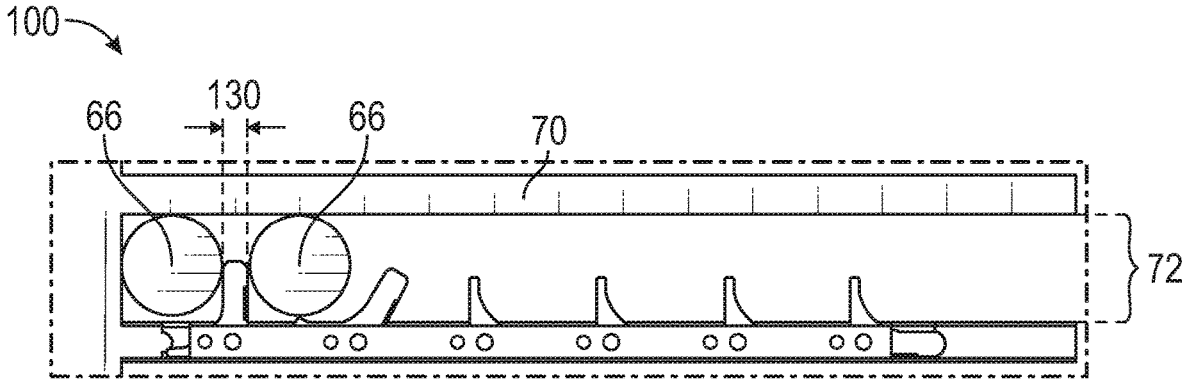
FIG. 11B is an additional view thereof with the additional pipe arranged adjacent the first pipe, according to one or more embodiments.
Figure 11C:
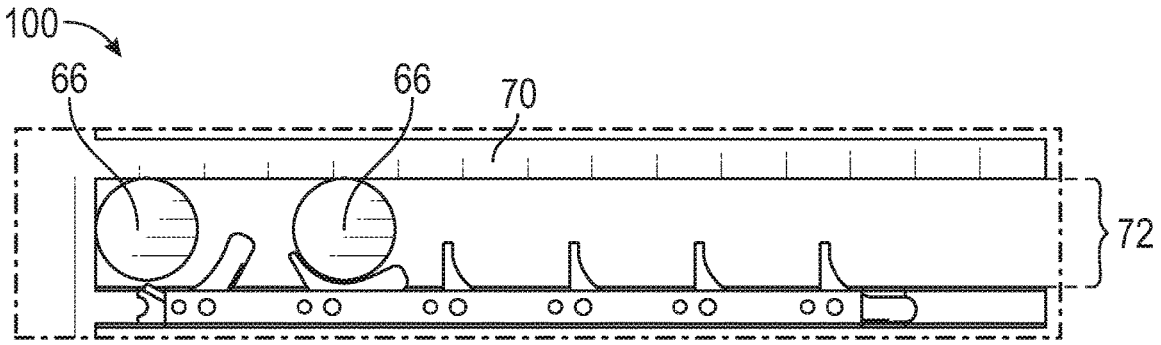
FIG. 11C is an additional view showing removal of the additional pipe, according to one or more embodiments.
Figure 11D:
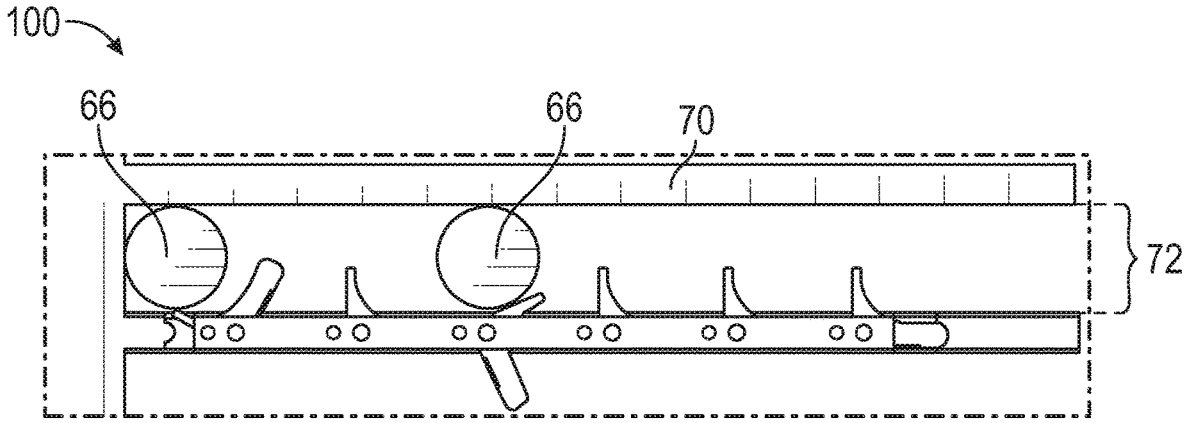
FIG. 11D is an additional view showing further removal of the additional pipe, according to one or more embodiments.
Figure 11E:
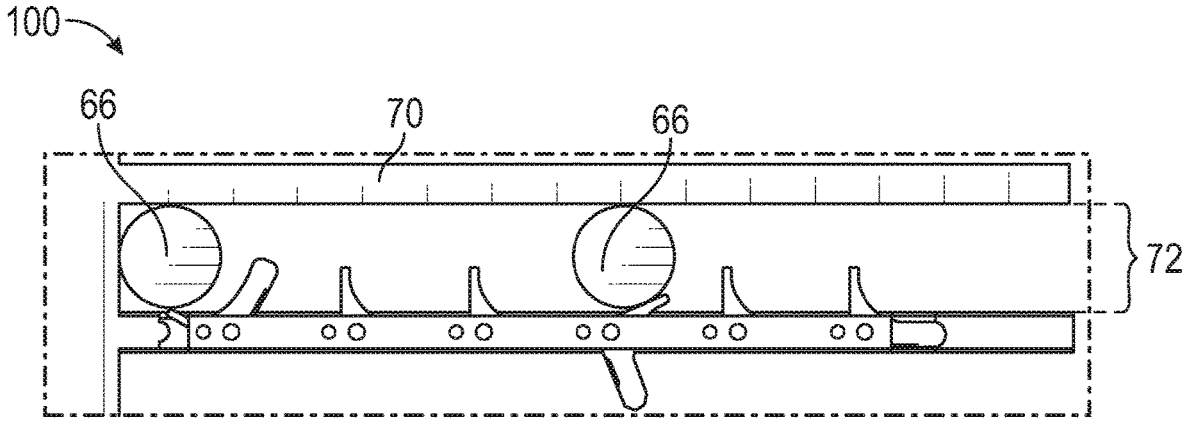
FIG. 11E is an additional view showing still further removal of the additional pipe, according to one or more embodiments.
Figure 12:
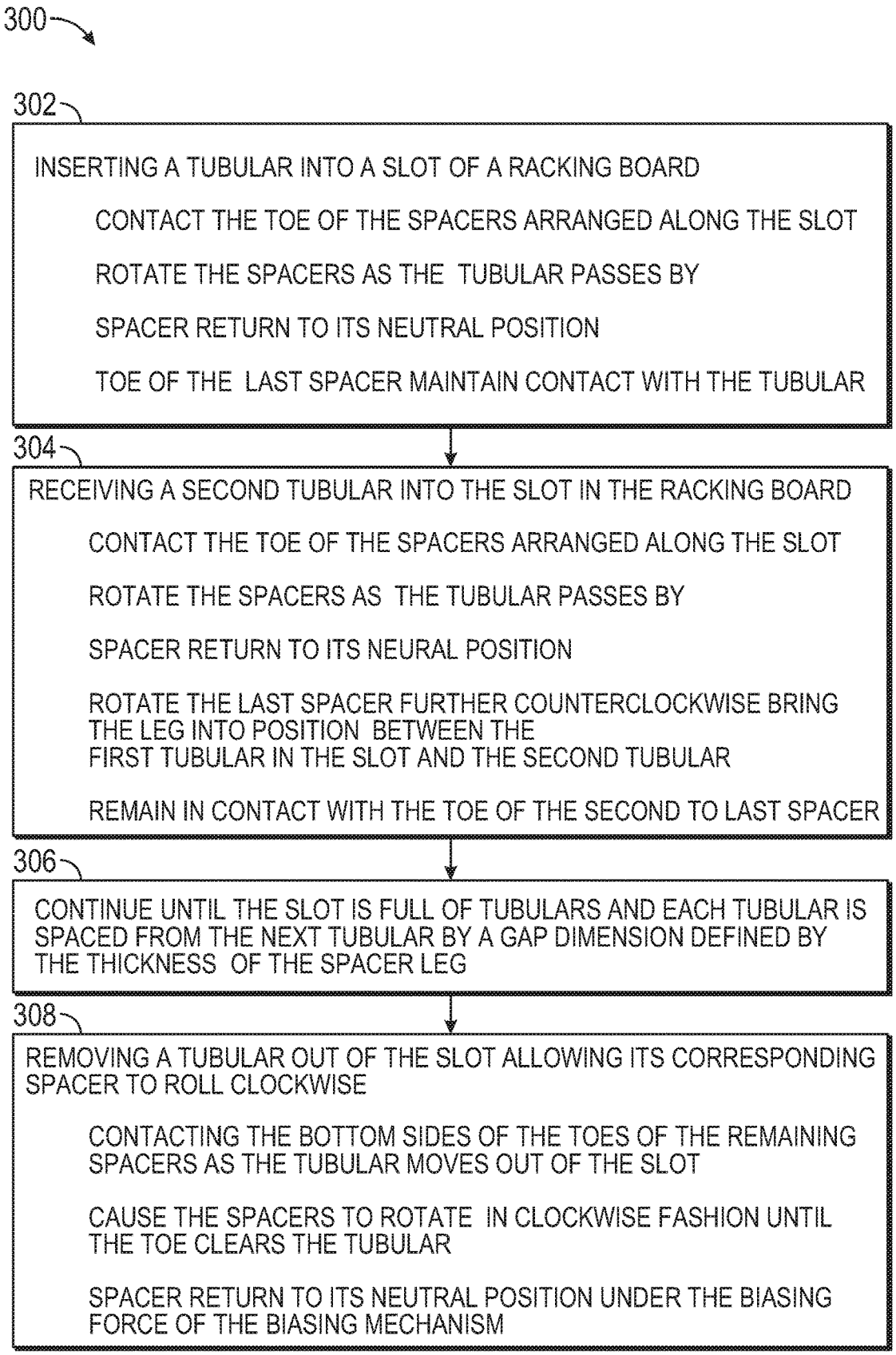
FIG. 12 is a block diagram of a method of operation of a passive spacer system, according to one or more embodiments.
Figure 13:
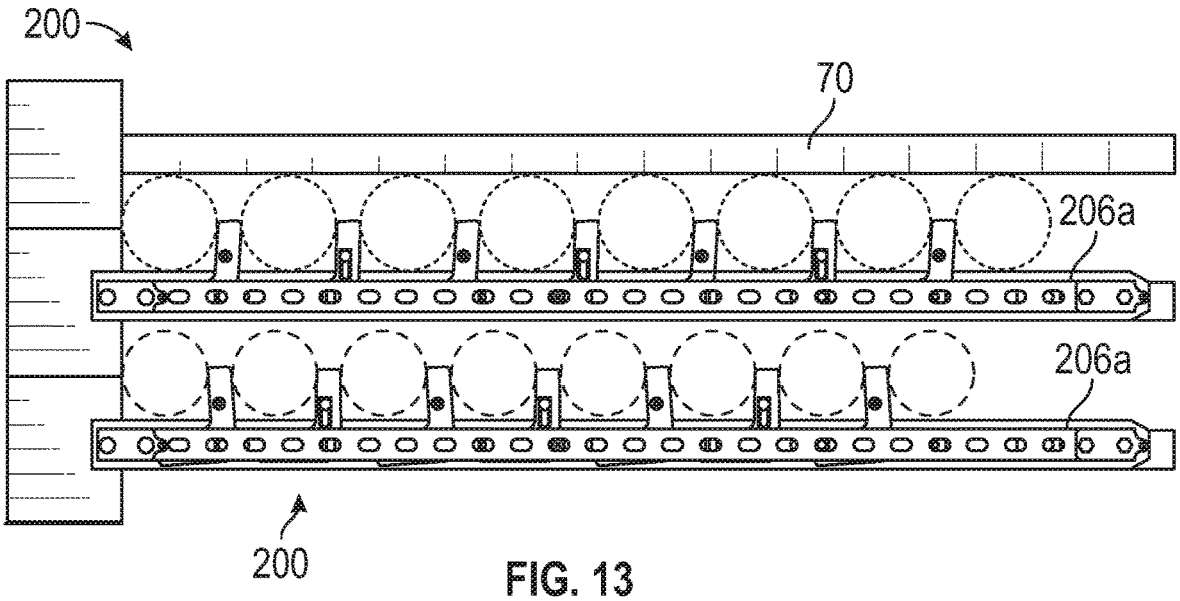
FIG. 13 is a top down view of an adjustable passive spacer system, according to one or more embodiments.

When the racking board is being unloaded, much the opposite may occur. As shown in FIG. 11C, the second tubular that was loaded in FIG. 11B is being removed from the slot. As shown, the motion of the second tubular out of the slot may allow its corresponding spacer to roll clockwise 308. As the tubular is removed from the slot, the method may include contacting the bottom sides of the toes of the remaining spacers as the tubular moves out of the slot. As shown in FIGS. 11D and 11E, the moving tubular may cause the spacers to rotate in clockwise fashion until the toe clears the tubular, when the spacer may return to its neutral position under the biasing force of the biasing mechanism. As each tubular is removed, its corresponding spacer may be allowed to return to its neutral position and the remaining spacers may be rotated by the tubular in a clockwise direction as each tubular passes each spacer and then each spacer may return to its neutral position.

In one or more examples, a passive spacer system 200 may be provided that has an adjustable spacer spacing to accommodate different tubular diameters. In this example, the spindles 208 extending between the upper and lower runners 206A/206B may be secured to the runners 206A/206B in an adjustable fashion. As with the above-described spacer system 100, the system 200 may include a frame 202 and a series of spacer assemblies 204 arranged along the length of the frame 202.

As before, the frame 202 may be configured for arrangement on a finger 70 of the racking board 56 to hold the spacer assemblies 204 in spaced apart position along the length of the fingers 70 and the corresponding slots 72. As shown, and like the system above, the frame 202 may be a ladder type frame with upper and lower runners 206A/206B having spindles 208 extending therebetween at each of the spacer assembly positions. Moreover, the upper and lower runners 206A/206B may include relatively rigid elongate elements such as bars, tubes, or other relatively rigid, long, and slender elements. However, as mentioned, the spindles 208 may have adjustable positions to accommodate different tubular diameters. For this purpose, the upper and lower runners may be U-shaped or C-shaped channels to provide a rail for movement of the spindles and corresponding spacer assemblies along the runners. As shown, the U-shaped or C-shaped channels may include a back side member 234 having a series of holes or slotted holes. Moreover, the front side of U-shaped or C-shaped channel may include a lip and/or J-lip 236 for securing or holding elements of the assembly within the cavity of the member formed by the U or C shape. In one or more examples, the upper and lower runners 206A/206B may include framing channels such as those manufactured and sold by Unitstrut, for example. Still other types of upper and lower runners 206A/206B may be provided.

The frame 202 may also include an adjustment mechanism 238 to provide for adjustability of the spindle locations along the runners 206A/206B. As shown, the adjustment mechanism 238 may include a plurality of sliding links 240 arranged along the mouth of the C-shaped or U-shaped channels. The sliding links 240 may include a rail engagement feature 242 allowing the links to be secured to the runners in sliding fashion as shown, for example in FIG. 16. That is, the links 240 may include a rail engagement feature 242 that corresponds with the lip and/or J-lip 236 on the U or C-shaped channel allowing the links 240 to slide along the channel, but remain secured to the channel. As shown, the rail engagement feature 242 may include a channel or jaw that receives the lip or J-lip of the runner 106A/106B. A rail engagement feature 242 may be positioned on each end of the links 240 as shown or a more full length engagement feature 242 may be provided. The rail engagement feature 242 may be provided on some or all of the links 240. That is, in one or more embodiments, rail engagement features 242 may be provided on alternating links 240 rather than on all of the links 240.

The links 240 may be generally plate like elements and may be arranged in consecutive overlapping fashion. For example, a series of primary links 240A may be arranged substantially adjacent to and engaged with the runner 206A/206B and series of secondary links 240B may be arranged to alternate along the length of the runner 206A/206B with the primary links 240A. The secondary links 240B may be spaced apart from the runner 206A/206B by the primary links 240A. That is, the secondary links 240B may overlay and overlap the primary links 240A on each end and on a side of the primary link 240A opposite the runner 206A/206B. In this example, the primary links 240A may include rail engagement features 242 and the secondary links 240B might not.

Figure 17A:
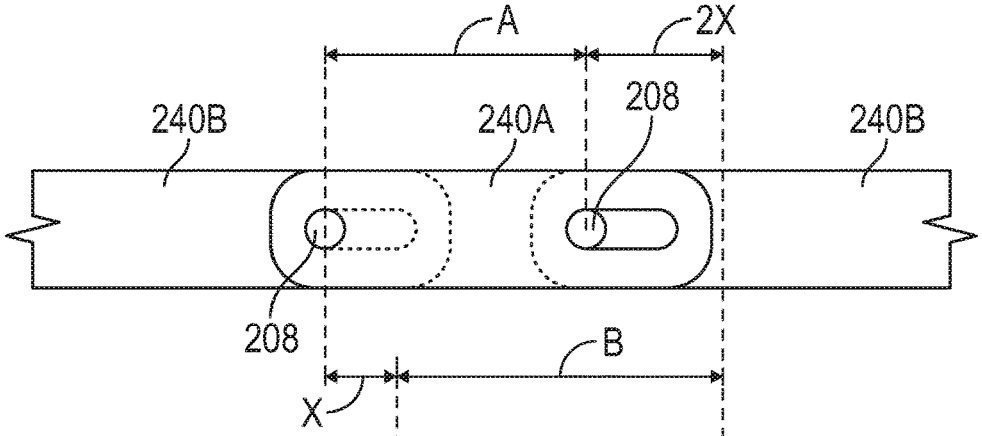
FIG. 17A is a close up top down view of a plurality of links of the adjustment mechanism shown in a collapsed position for smaller tubular, according to one or more embodiments.
Figure 17B:
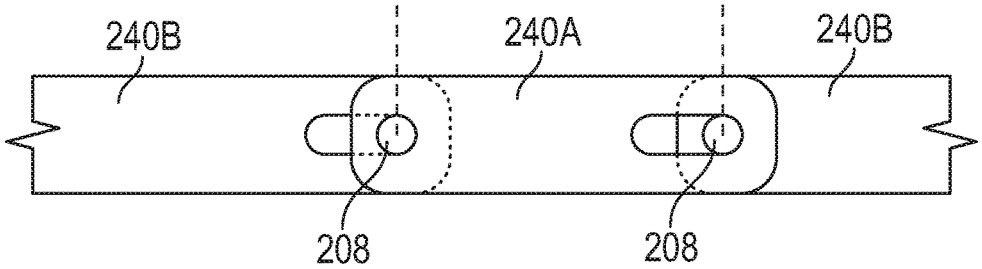
FIG. 17B is a close up top down view of a plurality of links of the adjustment mechanism shown in an extended position, according to one or more embodiments.

As shown in FIGS. 17A and 17B, the links 240A/240B may include a hole at one end and a slotted hole at an opposite end. The lengths of the links 240, the spacing of the holes, and the length of the slotted hole may be selected to allow the links 240 to be adjusted to accommodate differently sized tubulars 66. That is, as shown, when the series of links 240 on the runner 206A/206B is compressed or adjusted to the left as shown in FIG. 17A, the spindles 208 may be spaced from one another by a distance A. However, when the series of links 240 on the runner 206A/206B is fully stretched or adjusted to the right as shown in FIG. 17B, the spindles 208 may be spaced from one another by a distance B. In one or more examples, distance A may be selected to accommodate 4 inch tubulars while distance B may be selected to accommodate 5 inch tubulars. Still other tubular sizes and corresponding spacings may be selected to allow the passive spacer system 200 to accommodate different sizes of tubulars.

An adjustment mechanism 238 in the form of the described consecutive and overlapping series of links 240 may be provided on the top runner 206A and the bottom runner 206B. An adjustment link 244 that ties the two adjustment mechanisms 236 together and provides for adjustment of the same may be provided on the free end of the adjustment mechanisms 238. That is, as shown in FIG. 16, the adjustment link 244 may include a main body 246 extending between the top runner 206A and the bottom runner 206B, the adjustment link 244 may be slidable along the runners, and may include a rail engagement feature 248 at a top and bottom of the main body 246. The rail engagement feature 248 may be the same or similar to the rail engagement feature 242 of the links 240. In one or more embodiments, the rail engagement feature 248 may include a lug that extends from the adjustment link 244 and is arranged within the C-shaped or U-shaped channel. The main body 246 may be in the form of a generally vertically arranged and cylindrically shaped handle allowing for a user to grasp the adjustment link 244 and adjust the adjustment link position to change the spacing of the spacer assemblies 214, A pair of tines 250 may extend from the main body 246, one along each runner, and toward the plurality of links 240. The tines 250 may each be secured to a respective end of an upper or lower plurality of links 240 to tie movement of the main body or handle 246 to the plurality of links 240. As shown, a bore or passageway 252 may be provided vertically through the adjustment link 244. The bore or passageway 252 may be arranged in the main body or handle 246. In one or more examples, depending on the spacing of the holes or slotted holes in the back side member 234 of the U-shaped or C-shaped channel runners, the bore 252 may be a cylindrical bore or a slotted bore may be provided. While the bore 252 has been shown to extend through the main body 246 of the adjustment link 244, in one or more examples, the bore or passageway 252 may also extend through the tines 250 in the form of a pair of aligned hole or slotted holes in the tines 250. The bore or passageway 252 may be configured to receive an adjustment control.

The adjustment control 254 may be configured to extend through the adjustment link and engage the runners via the one or more holes or slotted holes in the back side 234 of the U-shaped or C-shaped channel runners. As shown in FIG. 16, the adjustment control 254 may include a pin with a pull ring that extends vertically through the top runner 206A, through the adjustment link 244, and through the bottom runner 206B. The pin may be a drop in that, for example, is placed by insertion through the top runner 206A and drops into place, being stopped from passing through the system by the pull ring. Still other approaches to providing an adjustment control 254 may be provided.

The spindles 208 of the system may be the same or similar to the spindles 108 described with respect to the system of FIGS. 4-10. That is, the spindles 208 may extend generally orthogonally between the upper and lower runners 206A/206B and may be adapted to sleevably receive the spacer assemblies 214. The spindles 208 may be generally cylindrically shaped to allow for rotation of the spacer 214, biasing mechanisms 216, or other items sleevably arranged thereon. However, rather than being relatively rigidly arranged between the upper and lower runners 206A/206B, the spindles 208 may be secured to upper and lower adjustment mechanisms 238 that slidably engage the upper and lower runners 206A/206B, In any case, the spindles 208 may extend generally orthogonally between the upper and lower runners 206A/206B and may define an axis of rotation of one or more aspects of the spacer assembly 214. Likewise, the spacer assemblies 214 of the adjustable passive spacer system 200 may be the same or similar to the spacer assemblies 241 described above with respect to FIGS. 4-10.

Figure 18:
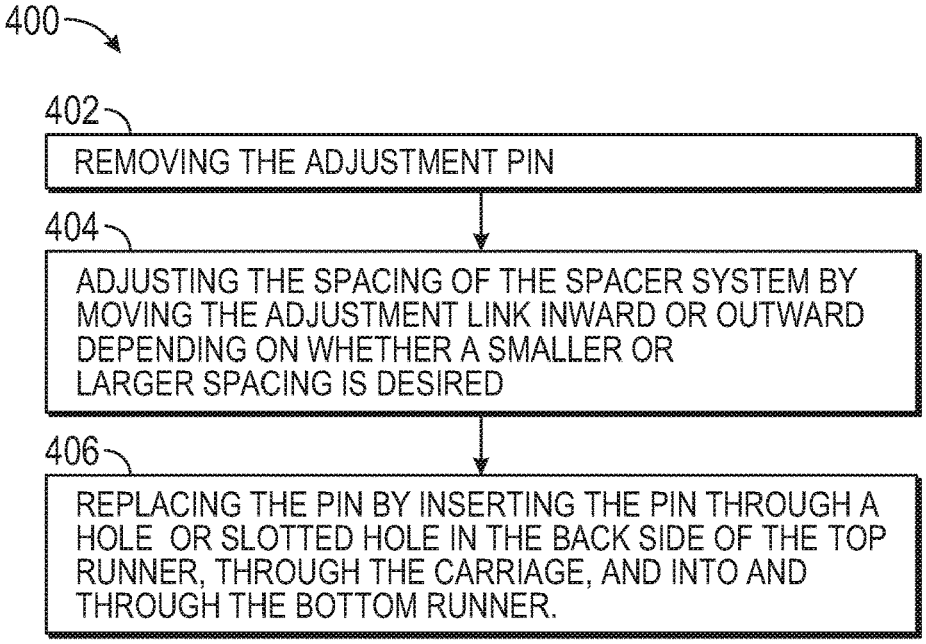
FIG. 18 is a block diagram of a method of adjustment of a passive spacer system.

FIG. 18 shows a method of adjustment of a passive spacer system 400. The method 400 may be performed in isolation or the method 400 may be performed in conjunction with the method of operation 300 of the spacer system described with respect to FIG. 12 and FIGS. 11A-11E. The method of adjustment 400 may include removing the adjustment control 402 by, for example, grasping the pull ring on the pin and removing the pin. The method may also include adjusting the spacing of the spacer system by moving the adjustment link inward or outward depending on whether a smaller or larger spacing is desired 404. The moving may include moving the adjustment link as far as it will go in either direction such that the spindles along the spacing system fully seat in the respective slotted holes in the links and, as such, remain equally spaced along the runner. The method may also include replacing the pin by inserting the pin through a hole or slotted hole in the back side of the top runner, through the adjustment link, and into and through the bottom runner 406.

It is to be appreciated that while a manual adjustment of the adjustment mechanism has been described, an automated adjustment may also be provided. For example, the adjustment link may engage the runners with a powered trolley, for example, allowing the position of the adjustment link along the runners to be automatically adjusted by powering the trolley to travel along the runners. A stop may be provided on each end of a trolley travel track such that the trolley may be moved between an inward most position and an outward most position by running the trolley until it encounters a stop, for example. Still other approaches to manually or automatically adjusting the spacing of the passive spacer system may be provided.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(t) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A passive spacer system, comprising:

a racking board comprising a slot;

a spacer comprising a first portion and a second portion extending from and fixed relative to the first portion, the spacer being arranged along the slot and biased in a neutral position where the first portion of the spacer impinges on the slot and the second portion of the spacer is clear of the slot, the spacer being configured to move due to motion of tubulars into and out of the racking board, which interact with the first portion of the spacer that impinges on the slot, wherein the spacer is configured to move:

from the neutral position to a spacing position wherein the second portion is positioned between tubulars and the spacer is biased toward the neutral position and held in the spacing position by one or more tubulars; and from the neutral position to a clearing position where both of the first and second portion are clear of the slot, wherein both the first portion and the second portion are configured to move when the spacer moves from the neutral position to the clearing position.

2. The system of claim 1, further comprising a frame, wherein the spacer is arranged on the frame and the frame is secured to a finger of the racking board adjacent the slot.

3. The system of claim 2, wherein the frame includes an upper runner and a lower runner and a spindle extending therebetween.

4. The system of claim 3, wherein the spindle defines an axis of rotation and the spacer is sleevably arranged on the spindle and configured to rotate about the axis of rotation.

5. The system of claim 4, further comprising a biasing mechanism configured to rotationally bias the spacer toward the neutral position.

6. The system of claim 5, wherein the spacer comprises a spacer post configured to engage the biasing mechanism when the spacer departs from a neutral position.

7. The system of claim 6, further comprising a frame post configured for engagement with the biasing mechanism when the spacer departs from the neutral position.

8. The system of claim 1, wherein the spacer comprises an L-shaped spacer having a toe, a body portion, and a leg, and is configured to rotate about an axis passing through the body portion.

9. The system of claim 8, wherein the leg is configured for positioning between tubulars in the spacing position, the leg having a thickness defining a spacing between the tubulars.

10. A passive spacer system, comprising:

a frame adapted for securing to a finger of a racking board and adjacent a slot; and a spacer comprising a first portion and a second portion extending from and fixed relative to the first portion, the spacer being pivotally arranged on the frame and biased in a neutral position such that when the frame is positioned adjacent the slot, a first portion of the spacer impinges on the slot and a second portion of the spacer is clear of the slot, the spacer being configured to move due to motion of tubulars into and out of the racking board, which interact with the portion of the spacer that impinges on the slot, wherein the spacer is configured to move:

from the neutral position to a spacing position where the second portion is positioned between tubulars and extends generally across the slot in a first direction while the first portion extends generally along the slot, wherein the spacer is biased toward the neutral position and held in the spacing position by one or more tubulars; and from the neutral position to a clearing position where both of the first and second portion are clear of the slot, the first portion extending generally along the slot and the second portion extending generally in a second direction opposite the first direction.

11. The system of claim 10, wherein the frame includes an upper runner and a lower runner and a spindle extending therebetween.

12. The system of claim 11, wherein the spindle defines an axis of rotation and the spacer is sleevably arranged on the spindle and configured to rotate about the axis of rotation.

13. The system of claim 12, further comprising a biasing mechanism configured to rotationally bias the spacer toward the neutral position.

14. The system of claim 13, wherein the spacer comprises a spring post configured to engage the biasing mechanism when the spacer departs from a neutral position.

15. The system of claim 14, further comprising a frame post configured for engagement with the biasing mechanism when the spacer departs from the neutral position.

16. The system of claim 10, wherein the spacer comprises an L-shaped spacer having a toe, a body portion, and a leg and is configured to rotate about an axis passing through the body portion.

17. The system of claim 16, wherein the leg is configured for positioning between tubulars in the spacing position, the leg having a thickness defining a spacing between the tubulars.

18. The system of claim 10, further comprising an adjustment mechanism configured to adjust the position of the spacer along a length of the frame.

* * * * *